US008336972B2

(12) United States Patent
Haab et al.

(10) Patent No.: US 8,336,972 B2
(45) Date of Patent: Dec. 25, 2012

(54) DISPLACEMENT DEVICE FOR PIVOTALLY HELD SEPARATION ELEMENTS AND ARTICLE OF FURNITURE

(75) Inventors: Gregor Haab, Allenwinden (CH); Martin Frei, Ottenbach (CH); Alfred Stutz, Hausen a.A. (CH); Rolf Heisig, Reutlingen (DE); Wladyslaw Wasilewski, Köln (DE)

(73) Assignee: Hawa AG, Mettmenstetten (CH)

( * ) Notice: Subject to any disclaimer, the term of this patent is extended or adjusted under 35 U.S.C. 154(b) by 288 days.

(21) Appl. No.: 12/662,684

(22) Filed: Apr. 28, 2010

(65) Prior Publication Data

US 2010/0270898 A1 Oct. 28, 2010

(30) Foreign Application Priority Data

Apr. 28, 2009 (EP) ..... 09158984

(51) Int. Cl.
*A47B 96/00* (2006.01)

(52) U.S. Cl. ..... 312/322; 16/366; 16/371

(58) Field of Classification Search ..... 312/270.3, 312/310, 311, 322, 323, 326, 327, 329, 332; 16/282, 285, 286, 366, 370, 371; 49/254, 49/258, 260

See application file for complete search history.

(56) References Cited

U.S. PATENT DOCUMENTS

| | | | | | |
|---|---|---|---|---|---|
| 972,412 | A * | 10/1910 | Taussig | 49/257 |
| 1,606,587 | A * | 11/1926 | May | 211/45 |
| 3,135,570 | A * | 6/1964 | Erismann | 312/311 |
| 4,186,972 | A * | 2/1980 | Hagen | 384/18 |
| 4,368,558 | A * | 1/1983 | Grass | 16/332 |
| 4,506,409 | A * | 3/1985 | Lautenschlager | 15/238 |
| 4,641,394 | A * | 2/1987 | Rock et al. | 16/302 |
| 4,815,797 | A * | 3/1989 | Haab et al. | 312/322 |
| 4,821,375 | A * | 4/1989 | Kozon | 16/360 |
| 4,987,640 | A * | 1/1991 | Lin | 16/327 |
| 5,144,722 | A * | 9/1992 | Salice | 16/240 |
| 5,149,180 | A | 9/1992 | Haab et al. | |
| 6,052,867 | A | 4/2000 | Haab et al. | |
| 6,401,298 | B1 | 6/2002 | Lenz | |
| 6,845,544 | B2 * | 1/2005 | Hofer | 16/246 |
| 2011/0094161 | A1 * | 4/2011 | Rees | 49/260 |

FOREIGN PATENT DOCUMENTS

| | | | |
|---|---|---|---|
| CA | 1040933 | | 10/1978 |
| CN | 101063392 | A | 10/2007 |
| DE | 2 045 763 | | 6/1972 |
| DE | 39 14 103 | A1 | 10/1990 |
| EP | 337558 | * | 10/1989 |
| EP | 0 387 560 | A2 | 9/1990 |
| EP | 0 909 864 | A2 | 4/1999 |
| EP | 1 048 809 | A1 | 11/2000 |
| KR | A-2002-0011199 | | 2/2002 |

* cited by examiner

*Primary Examiner* — James O Hansen
*Assistant Examiner* — Matthew Ing
(74) *Attorney, Agent, or Firm* — Oliff & Berridge, PLC

(57) ABSTRACT

The displacement device serves to hold a separation element, which is pivotally connected to a bracket, which is held slideably by a first beam of a scissor assembly and firmly by a second beam of the scissor assembly with a scissor assembly bearing. The scissor assembly bearing comprises a profile body that is adapted to the bracket and can be connected thereto, which profile body comprises a profile part which is connected articulated to the first end element of an adjusting lever, of which the second end element is connected on the one hand pivotally with the second beam and on the other hand is held by an adjusting bolt, of which the threaded shank is rotatably mounted in a threaded channel of the profile body.

15 Claims, 22 Drawing Sheets

Figure 1:
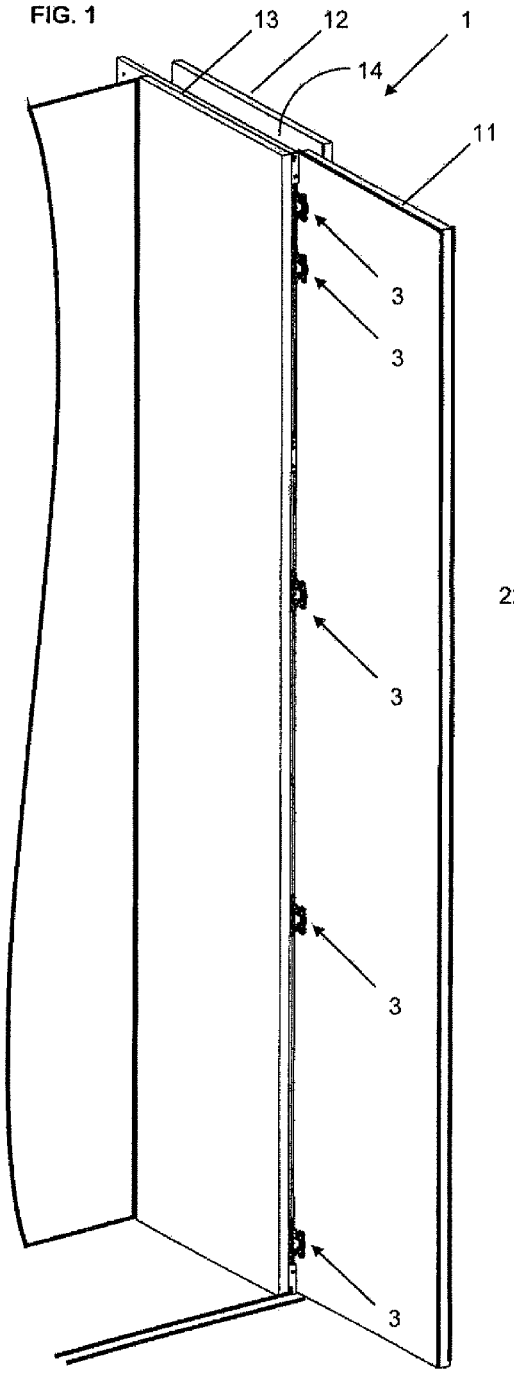

DISPLACEMENT DEVICE FOR PIVOTALLY HELD SEPARATION ELEMENTS AND ARTICLE OF FURNITURE

The invention relates to a displacement device for pivotally held separation elements and an article of furniture provided with this displacement device according to the preamble of claims 1 and 16.

In order to separate or form areas or to close off articles of furniture, glass or wooden panels, doors or blinds are often used.

As a pivotally held separation element causes aesthetic interference in most cases after the article of furniture has been opened, solutions have been developed which allow the separation element, after the article of furniture has been opened, to be inserted into an intermediate space provided in the article of furniture, said intermediate space being delimited possibly by an intermediate wall.

[1], U.S. Pat. No. 5,149,180 A, discloses an article of furniture with a displacement device, by means of which a door held pivotally on a bracket can be sunk from a position of use into a door compartment, which comprises at least one side wall. The bracket is held in a vertical position during travel into the door compartment and travel outwards by a scissor assembly, which comprises two crossed beams connected to each other in an articulated way. One of the two crossed beams is held with its upper end on the upper side of the bracket on a scissor assembly bearing so as to be pivotable and with the lower end within the door compartment in a guide device so as to be pivotable and vertically displaceable. The second beam is held with the upper end within the door compartment in anchoring means so as to be pivotable and with the lower end on the lower side of the bracket so as to be pivotable and vertically displaceable. Upon lowering and outward travel of the doors the upper ends of the crossed beams thus remain constantly at the same height while the lower ends are vertically displaced. In an ideal case the pivot points at the ends of the crossed beams constantly form a rectangle. By releasing the scissor assembly bearing from the bracket said bracket can be vertically displaced in order to position the door within the door compartment at the same distance from the upper side and the lower side of the cupboard.

Furthermore an upper and a lower rail are provided in [1], along which the bracket is guided by means of guide plates in order to prevent a rotation and jamming of the scissor assembly.

By reason of various influencing factors, however, a situation can arise in which the bracket is not vertically orientated. This problem is countered in [1] in that the anchoring means provided in the door compartment can be adjusted, through which the upper end of the second rail element is held pivotally within the door compartment. The anchoring means provided on the inner side of the side wall are connected by means of a first and a second screw to an adjusting part provided on the outer side of the side wall, whereby a clamping connection is formed. After the release of the clamping connection the anchoring means and the adjusting part can be rotated about the stationarily held first screw while the second screw is displaceable in a hollow space of the side wall.

After the two screws have been loosened the lower side of the anchoring means, on which the pivot point of the second crossed element is provided, can thus be displaced forwards and back in such a way that the scissor assembly can be inclined with the bracket forwards and back and fixed again at an appropriate point. If after the mounting of the doors said doors hang somewhat outwardly the two screws are loosened and the anchoring means and the adjusting part are rotated until the bracket is vertically orientated with the door. Following complete adjustment the screw connection is tightened again so that a clamping connection is formed between the anchoring means and the adjusting part and also the side wall lying between them. In addition the adjusting part is secured by means of a third screw against further rotation.

In this device the adjustment thus requires access to the adjusting part provided on the side wall, which adjusting part must be released and rotated. At the same time it is to be ensured that the bracket and the door are actually inclined to the necessary extent. It may thereby be necessary to adjust them several times. It is further to be ensured that the door with the bracket, after the loosening of the screws, does not tilt forwards and pull with it the anchoring means and the adjusting part. After the loosening of the screws the door must therefore be held and the setting changed in steps and verified. This results in considerable resources for precise adjustment of the device. It is further to be noted that the respective securing of the clamping connection by means of the third screw also requires resources and is scarcely still reliable after several adjustments, in which the third screw has been positioned at adjacent points.

Further, additional drawbacks result. In many cases the side wall defining the door compartment is not freely accessible. This is the case for example if the cupboard lies laterally against a wall of a building. In this case the cupboard must be pushed forwards in order to be able to carry out the adjustment. It is further possible for the cupboard to stand freely and for the side wall to be freely visible. In this case the adjusting part with the screws causes aesthetic interference.

It is further to be noted that not only the adjustment but also the installation of this device are associated with relatively high resources as the side wall is to be provided with the corresponding bores.

It is thus an object of the present invention to create an improved displacement device for pivotally held separation elements and an article of furniture provided with this displacement device.

In particular a simply assembled displacement device is to be created, which can be installed with minimum resources and precisely adjusted.

This object is achieved with a displacement device and with an article of furniture provided with this displacement device, whereby said displacement device and said article of furniture have the features defined in claims 1 and 16 respectively. Advantageous embodiments of the invention, in particular an advantageously designed carriage and an advantageously designed hinge, are defined in further claims.

The displacement device serves to hold a separation element, which is pivotally connected to a bracket, which is slideably held by a first beam of a scissor assembly and firmly held by a second beam of the scissor assembly by means of a scissor assembly bearing.

According to the invention the scissor assembly bearing comprises a profile body that is adapted to the bracket and can be connected thereto. Said profile body comprises a profile part which is connected in an articulated way to the first end element of an adjusting lever, of which the second end element is connected on the one hand pivotally with the second beam and on the other hand is held by an adjusting bolt, of which the threaded shank is mounted rotatably in a threaded channel of the profile body.

By rotating the adjusting bolt the distance between the scissor assembly bearing, which is held on the bracket, and the second beam, and hence the inclination of the bracket, can selectively be adjusted. The scissor assembly bearing connected to the second beam is preferably fixed to the upper side of the bracket, while the first beam is guided slideably on the lower side of the bracket. If the user establishes that the separation element is downwardly inclined be can reduce the distance between the scissor assembly bearing and thus the upper side of the bracket and the associated end element of the second beam. Insofar as the displacement device is mounted in an article of furniture and the separation element can be lowered in a door compartment, the separation element can be completely pulled out and the adjusting bolt can be accessed in order to carry out the necessary adjustment.

The adjustment can thus take place directly at the bracket and does not have to be carried out at an end of the scissor assembly lying at a distance, as is necessary with the subject matter of [1]. No clamping device thereby needs to be loosened and tightened again after the adjusting element. The separation element does not have to be held during the adjusting process but can be adjusted under load. The adjustment therefore takes place under load with minimum resources with millimetre precision. A subsequent adjustment is not necessary as no load change takes place after completion of the adjusting process.

In a preferred embodiment the threaded channel serving to receive the adjusting bolt runs through the profile body, preferably running through the profile part connected to the adjusting lever, from the rear side facing the scissor assembly as far as the front side. The adjusting bolt can thus be detected from the front side of the profile body and manipulated.

In this connection the adjusting bolt preferably comprises on the front side a tool opening, for example a hexagon socket, into which a tool can be introduced. The adjusting screw can be detected and rotated in this preferred embodiment for example with a hex key.

It is preferably provided that the adjusting bolt comprises at the end facing the adjusting lever a bolt head, which is rotatably held in a receiving opening provided in the adjusting lever. In this embodiment the adjusting bolt does not press unilaterally against the adjusting lever but instead holds it securely and guides it to the position desired by the user, forwards or back.

In a further preferred embodiment the adjusting lever comprises on the second end element a mounting lug, through which a bearing screw connected to the second beam is guided.

The mounting lug preferably comprises an elongated opening, along which the shank of the bearing screw can be displaced during the adjusting process. In this way the shank of the bearing screw can change its position within the mounting lug, whereby blocking is prevented.

At the end of the adjusting lever furthest away from the rotation point a guide nose is preferably provided, which is guided in a guide channel, which is provided in an end element of the profile part. In this way it is ensured that the adjusting lever can only be rotated in one plane.

The profile body of the scissor assembly bearing preferably comprises an L-shaped profile or a U-shaped profile, which is optionally provided with holding elements such as holding claws and holding strips, as well as comprising threaded bores, in which fixing screws can be turned against the bracket in order to mutually block the bracket and the profile body. By loosening the fixing screws the scissor assembly bearing can be released from the bracket, after which the bracket, which is normally connected to the separation element by means of a plurality of hinges, can be vertically displaced.

It is thus possible with the measures described above to precisely adjust the separation element in height and inclination with most simple measures.

Particularly if heavy separation elements are used, then the scissor assembly is preferably unloaded. For this purpose according to the invention a carriage with running wheels is mounted at the upper end of the bracket, which running wheels are guided on a running rail. The weight of the separation element is thus carried by the carriage, while the remaining torque is absorbed by the substantially unloaded scissor assembly.

In this case too, the correct setting of the height of the bracket held by the carriage is essential. The optimal functioning of the displacement device is indeed only guaranteed if all elements are tailored to each other without defects. It is therefore in turn of central importance that the height of the bracket can be precisely set in relation to the running rail extending perpendicular thereto with simple measures. Thereby it shall be avoided that the carriage must be released from the bracket and displaced, which would make simple and precise adjustment practically impossible.

In a preferred embodiment the body of the carriage thus comprises a housing, in which an adjusting element is mounted so that it can be displaced in height. On the upper side of the adjusting element a support lever is preferably rotatably held, on which support lever the two running wheels are fixed by means of wheel axles. By using the rotatable support lever this results in optimal load distribution on both running wheels. Irrespectively of the inclination of the receiving profile relative to the running rail, the carriage thus constantly performs its task optimally. A one-sided loading only of one running wheel, which could lead to early wear, is avoided.

The adjusting element preferably comprises a holding bar, on the upper side of which the support lever is rotatably held by means of a central axle, and on the lower side of which holding bar a holding wedge is provided. The upper wedge face of the holding wedge, which is inclined in relation to the running direction of the carriage, cooperates with the lower wedge face of an adjusting wedge, which can be displaced in relation to the holding wedge by means of an adjusting screw held by the carriage body. With the displacement of the adjusting wedge the holding wedge is thus displaced upwards or downwards. The adjusting screw is typically mounted in the carriage housing parallel to the running direction of the carriage.

Preferably, an adjusting screw provided with a threaded shank is used, which adjusting screw has a screw head at each end, said screw heads being held so as to be rotatable in a bearing opening of the carriage housing but not displaceable. The bearing openings are provided in two sides of the carriage housing lying opposite each other and the adjusting screw thus runs completely through the carriage housing. The threaded shank of the adjusting screw is held in a threaded channel of the adjusting wedge and the latter is thus displaced with each rotation of the adjusting screw along said adjusting screw. Access to the adjusting screw is thus possible from both sides of the carriage housing. An adjustment is in turn possible from the front side. The adjusting bolt of the scissor assembly bearing and the adjusting screw of the carriage can be manipulated with the same tool.

The inventive carriage can be used particularly advantageously in the displacement device set out here. In the case of further separation elements such as sliding doors or sliding shutters, which are directly hung on a carriage, similar problems arise and these can be resolved with the inventive carriage. The use of this carriage is not therefore limited to the present invention, but can instead be used with any separation elements.

In the inventive displacement device the separation element is connected to the bracket by means of at least one hinge. Hinges for furniture doors are known from numerous publications.

[2], EP 0 909 864 A2, discloses a hinge provided for furniture doors, wherein said hinge has a hinge arm, which is connected to a hinge cup by means of an outer and inner articulated lever, which together with four articulated axles form a four-bar linkage. One of the articulated levers is formed as a two-armed lever with an arm pointing freely into the hinged arm, which arm pointing freely into the hinged arm is impacted by a spring mounted in the hinged arm and which comprises two side webs orientated perpendicular to the articulated axles. The spring thereby presses on a preferably cylindrical metal pin, which is held between the side webs of the arm of the articulated lever projecting freely into the hinged arm.

Through the use of a metal pin, which consists of substantially higher-quality and more abrasion-resistant material than the articulated lever, the lifespan of the hinge can be considerably increased in relation to the lifespan of a hinge wherein the spring rubs directly on the articulated lever.

[3], EP 1 048 809 A1, discloses a hinge, wherein a leaf spring acts on a block, for example made of plastic, which is placed upon an articulated lever. Through the use of a plastic block it is intended in turn to reduce the friction between the articulated lever and the leaf spring.

[4], DE 3914103 A1, describes a solution, in which the spring acts via a single-armed lever upon the articulated lever. In this solution the spring remains protected while the friction takes place between the single-armed lever and the articulated lever.

The mutual friction between device parts thus leads to a more or less earlier wear of the hinge. The use of additional parts, for example the aforementioned metal pin, the plastic block or the single-armed lever, only leads to a reduction in the wear, but also to greater resources and space requirement.

A further drawback is that the aforementioned friction between the device parts absorbs forces, which are no longer available for the operation of the hinge.

In addition the force effect of the spring upon the separation element connected to the hinge is relatively low, so that the functions for opening or closing the separation element are barely supported, only partially supported or not supported at all by the spring force. Typically there is only a holding of the separation element in one position of the separation element. In the subject matter of [4] a relatively low closing moment occurs merely in the closed position of the separation element.

In addition, interference-causing noise results on account of the friction within the hinge.

Furthermore the spring takes up a relatively large amount of space in the hinges of [2], [3] and [4], whereby space is by nature only in short supply.

A further drawback of the devices of [2], [3] and [4] is that the hinge position cannot be adjusted when the separation element is open. In the open position the separation element is therefore not orientated perpendicular to the furniture and to the door compartment possibly provided therein. This results on the one hand in a disadvantageous aesthetic impression and on the other hand the separation element can stop against the side walls of the door compartment, whereby interference-causing noise and appearance of wear can arise.

It is thus an additional object of the invention to improve the known hinges and to overcome the drawbacks described. In particular a hinge is to be created, in which the occurrence of wear on the hinge itself and on parts connected thereto can be avoided. In particular friction between device parts of the hinge and the wear of these device parts are to be avoided. Furthermore the noise caused by the hinge is to be avoided or significantly reduced.

Furthermore it shall be possible to use a more powerful spring element, of which the force can be optimally transferred to the associated articulated lever. Said spring element shall at the same time require little space.

The lever mechanism is preferably to be designed in such a way that through the lever mechanism and the spring element in both end positions a strong function moment is exerted upon the separation element so that the separation element is guided independently into the respective end position.

The hinge is thereby to be constructed in a space-saving way and to be mountable on any separation element such as glass panels or wooden panels.

This object is achieved with a hinge as defined in claims 12-15.

The hinge comprises a mounting element, which can be connected to the separation element, said mounting element being in particular a hinge cup, which is connected by means of a lever mechanism to a mounting part, which can be fixed to the bracket. Said mounting part is connected in an articulated way to the first end element of a drive lever driven by the drive spring and to the first end element of an adjusting lever.

According to the invention the second end element of the adjusting lever is connected in an articulated way to the first end element of a mounting lever, which is connected or can be connected to the mounting element. The second end element of said mounting lever is connected to the second end element of the drive lever, which presses the mounting lever against the adjusting lever so that the third lever shaft connecting the adjusting lever and the mounting lever is pressed towards the drive lever when the separation element is open and away from the drive lever when the separation element is closed.

The end position of the hinge is reached with open separation element when the third lever shaft or parts of the adjusting lever or mounting lever connected thereto, stop against the drive lever. The end position of the hinge is reached with closed separation element at the latest when the mounting element, possibly the hinge cup, lies against the drive lever. The adjusting lever and the mounting lever thus form a knee joint at the connection point, which knee joint, depending upon the position, is pressed by the drive lever in one or the other direction. In the position in which the rotation axes of the adjusting lever and of the mounting lever lie precisely in a plane, they are pressed towards each other. As soon as the separation element is rotated only minimally in one direction or the other the knee joint is likewise guided in a corresponding direction and folded, whereby the separation element travels automatically until the stop into the end position, in which the separation element is either open or closed.

Due to the optimal effect of the drive spring upon the drive lever a considerable force is exerted upon the separation element so that the related process for opening or closing the separation element is carried out practically automatically. The drive spring thereby acts with virtually constant force upon the same point of the drive lever and a virtually constant acceleration thus results over the whole pivot range and any friction between the parts is avoided. Correspondingly the occurrence of wear and noise is also avoided. Furthermore no auxiliary elements are required. A drive spring is preferably used, which comprises at least one spring package present in the form of a helical spring, which spring package is held together with the relevant end element of the drive lever by a first lever shaft. The end elements and/or an intermediate element of the drive spring rotate/s with the drive lever therefore about the same axis. The relevant end element of the drive lever and one or two spring packages of the drive spring can thus be arranged beside each other and thereby only take up a small cylindrical space volume.

For this purpose the mounting part preferably comprises a first bearing body, in which the first lever shaft serving to hold the drive shaft and the drive spring is mounted. On one or both sides of the first bearing body a respective spring package of the drive spring formed as a helical spring is arranged, which drive spring presses on the one hand against the mounting part and on the other hand with an end element or a middle element against the drive lever.

The adjusting lever is possibly likewise held by the first lever shaft. The mounting part, however, preferably comprises at least one second bearing body, in which a second lever shaft serving to hold the adjusting lever is mounted.

Furthermore the second end elements of the drive lever and of the mounting lever are connected to each other by a fourth lever shaft.

Thus, a lever mechanism results, which is driven by the drive spring with great force in an essentially friction-free manner.

The drive spring can for example comprise for each spring package 10 windings and a wire diameter of for example 0.5 mm to 2 mm. The number of windings and the wire diameter are thereby adapted to the load of the door element. It is interesting that with the inventive construction of the hinge the spring force can be increased practically as desired without the space requirement increasing significantly. It is further particularly advantageous that the spring path/the rotation angle of the corresponding end element or middle element of the drive spring is very large and the drive spring thereby supplies a practically constantly high force effect over the whole movement range of the hinge.

As mentioned, when the separation element is open the third lever shaft is guided towards the drive lever until the third lever shaft or parts of the adjusting lever or of the mounting lever stop against the drive lever. In a preferred embodiment therefore a stop element is provided, which defines the minimum distance of the third lever shaft to the drive lever. A rotatably mounted stop screw is preferably provided in the drive lever, by means of which stop screw the minimum distance between the third lever shaft and the drive lever, and hence the orientation of the separation element in the open end position, can be set. A stop element, which cooperates with the stop screw, is preferably provided on the adjusting lever.

In a further preferred embodiment the mounting element, possibly the hinge cup, can be displaced in relation to the mounting lever and can be fixed by means of a connecting screw. The mounting lever can thus be fixedly connected to the mounting element or alternatively be connected in a selected position to the mounting element, whereby a higher flexibility is achieved. The separation element can thus be orientated with simple measures parallel to the mounting strip. This is achieved particularly simply in that a connecting element with a toothing is provided on the mounting lever and a tool recess is provided in the hinge cup, into which tool recess a toothed tool can be introduced, in that the toothing of the tool cooperates with the toothing of the connecting element. After loosening of the connecting screw, provided for example on the connecting element, the toothed tool can be rotated and the hinge cup can selectively be displaced in relation to the connecting element, after which the connecting screw is securely tightened again.

In preferred embodiments the external forms of the drive lever, the adjusting lever and the mounting lever are adapted to each other so that they can be displaced into one another at least partially. For example the mounting lever comprises at least in part a U-shaped profile, which is fitted into the hinge cup and/or which serves to receive the drive lever in the position in which the third bearing shaft is guided towards the drive lever.

It is further preferably provided that the second end element of the adjusting lever and the first end element of the mounting lever each comprise two adjacent bearing elements, serving to receive the third bearing shaft. Said bearing elements are spaced apart from each other in such a way that the drive lever can be guided between them towards the third bearing shaft and can thus be lowered at least partially between parts of the adjusting lever and the mounting lever.

Figure 2:
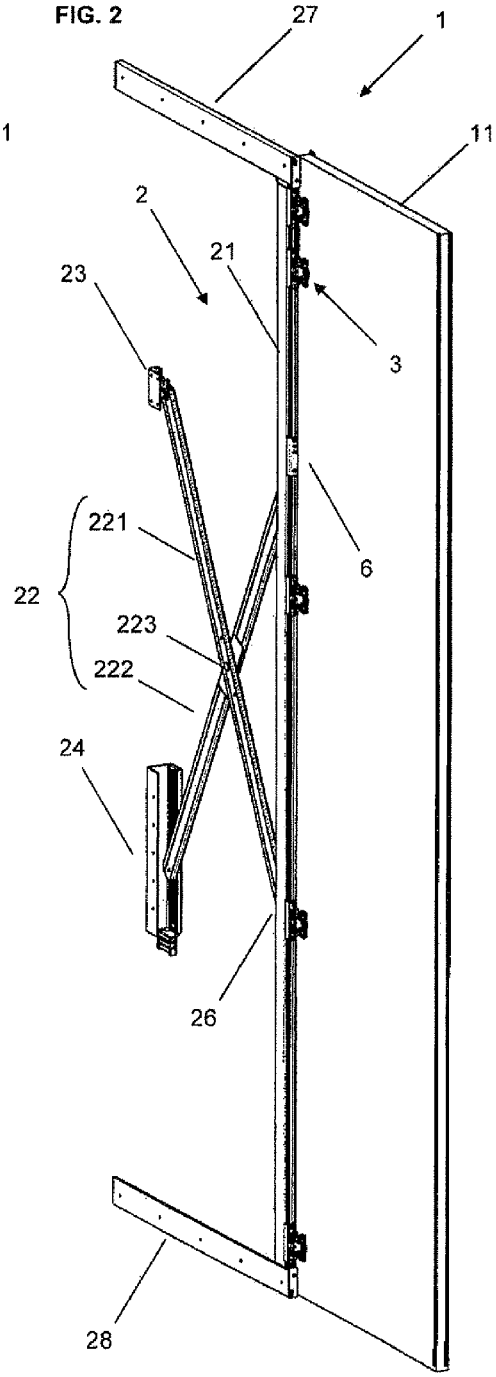
Figure 3A:
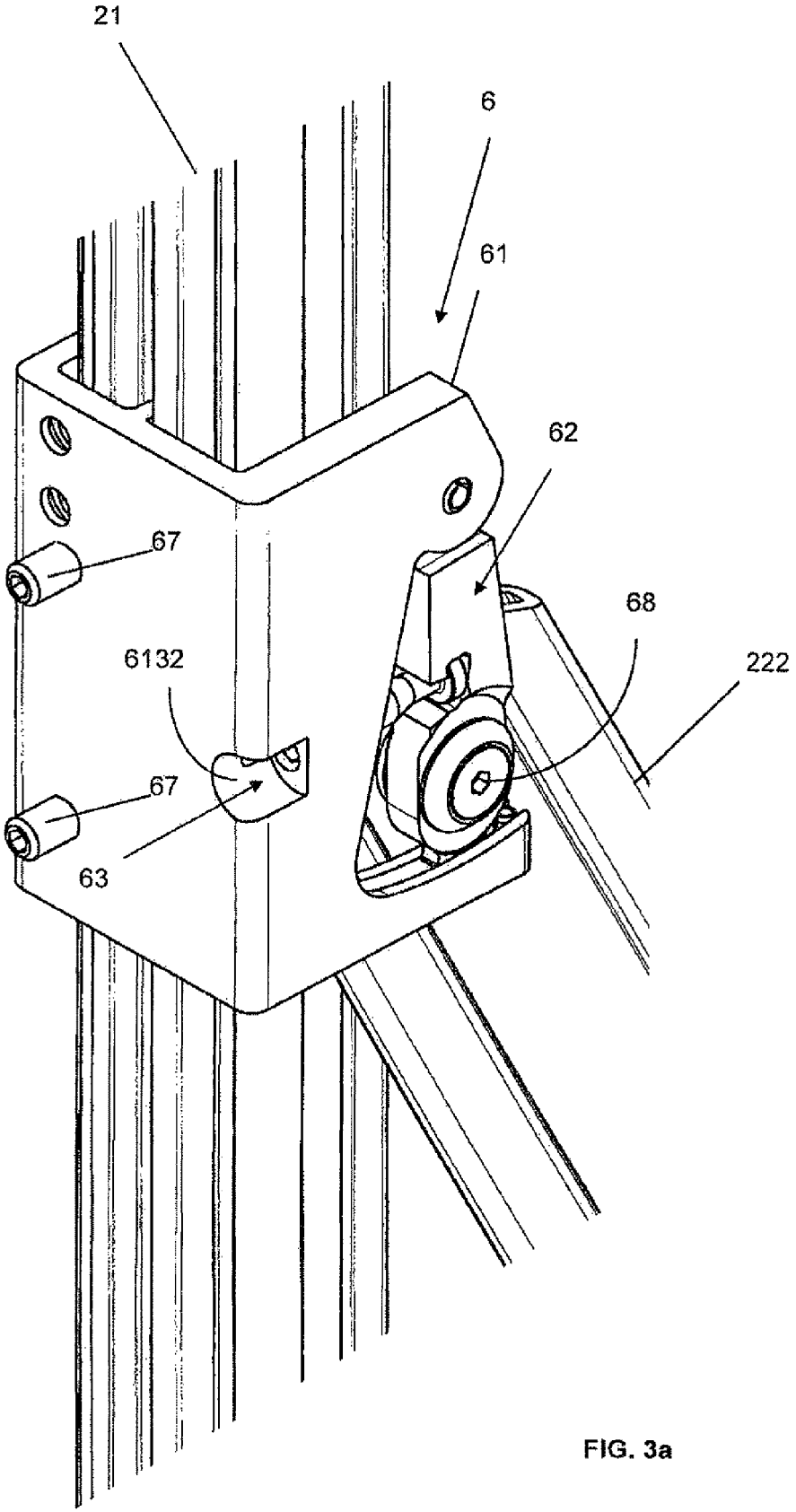
Figure 3B:
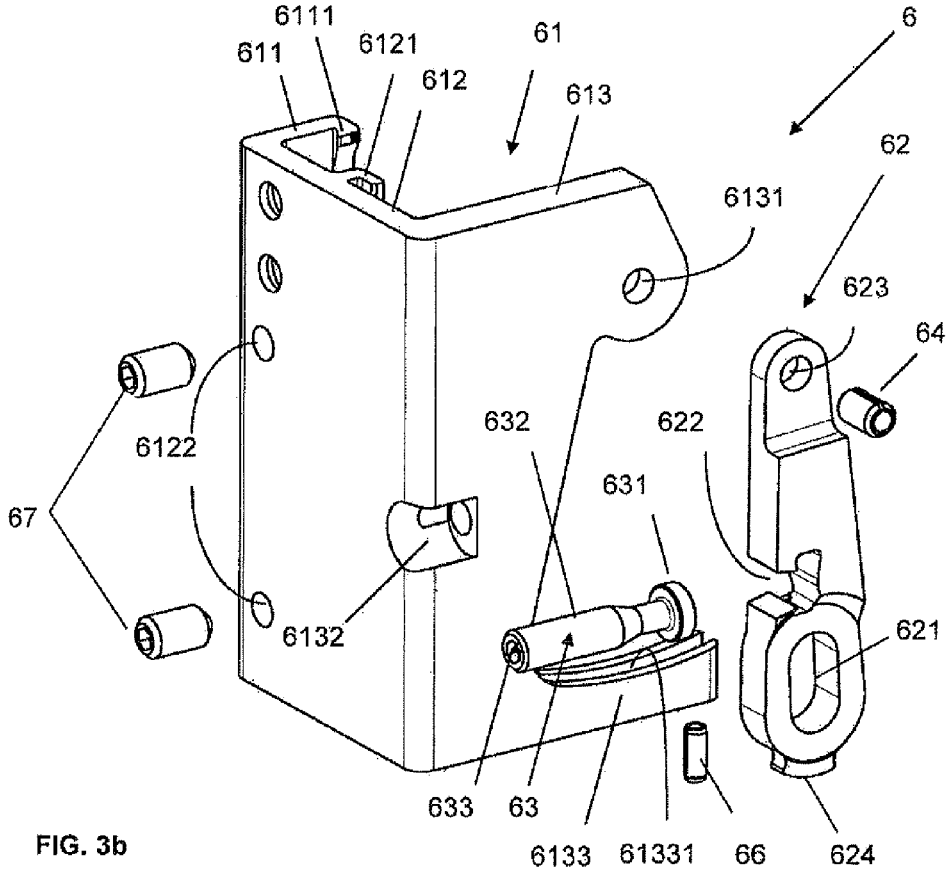
Figure 3C:
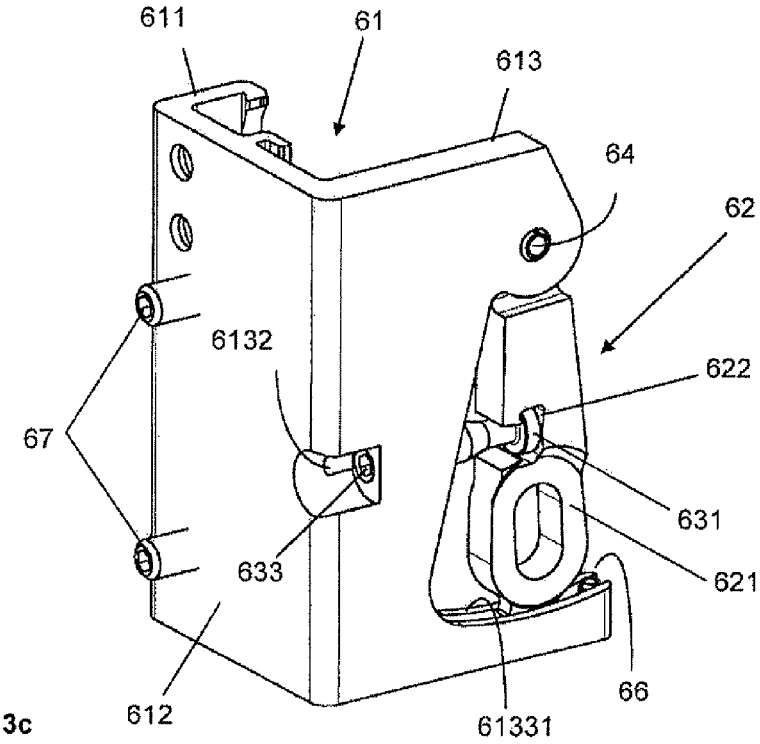
Figure 4A:
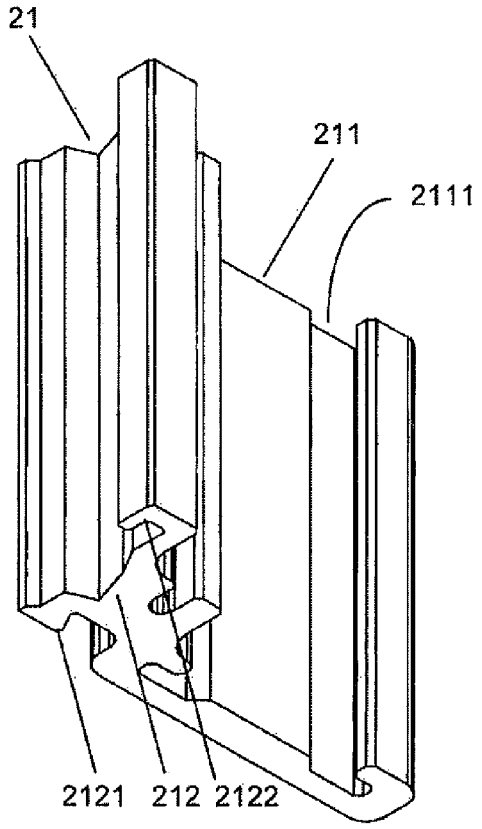
Figure 5:
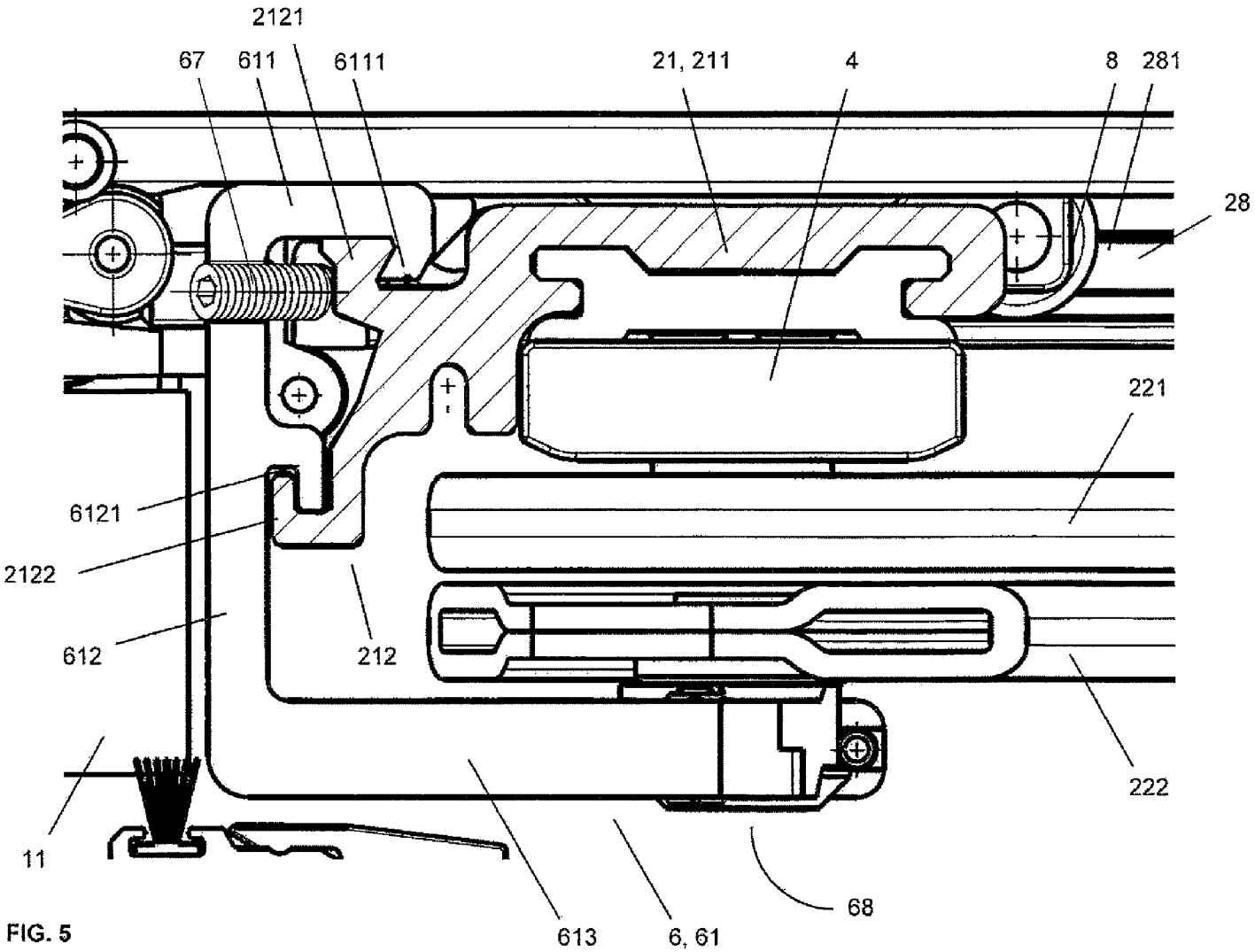
Figure 6A:
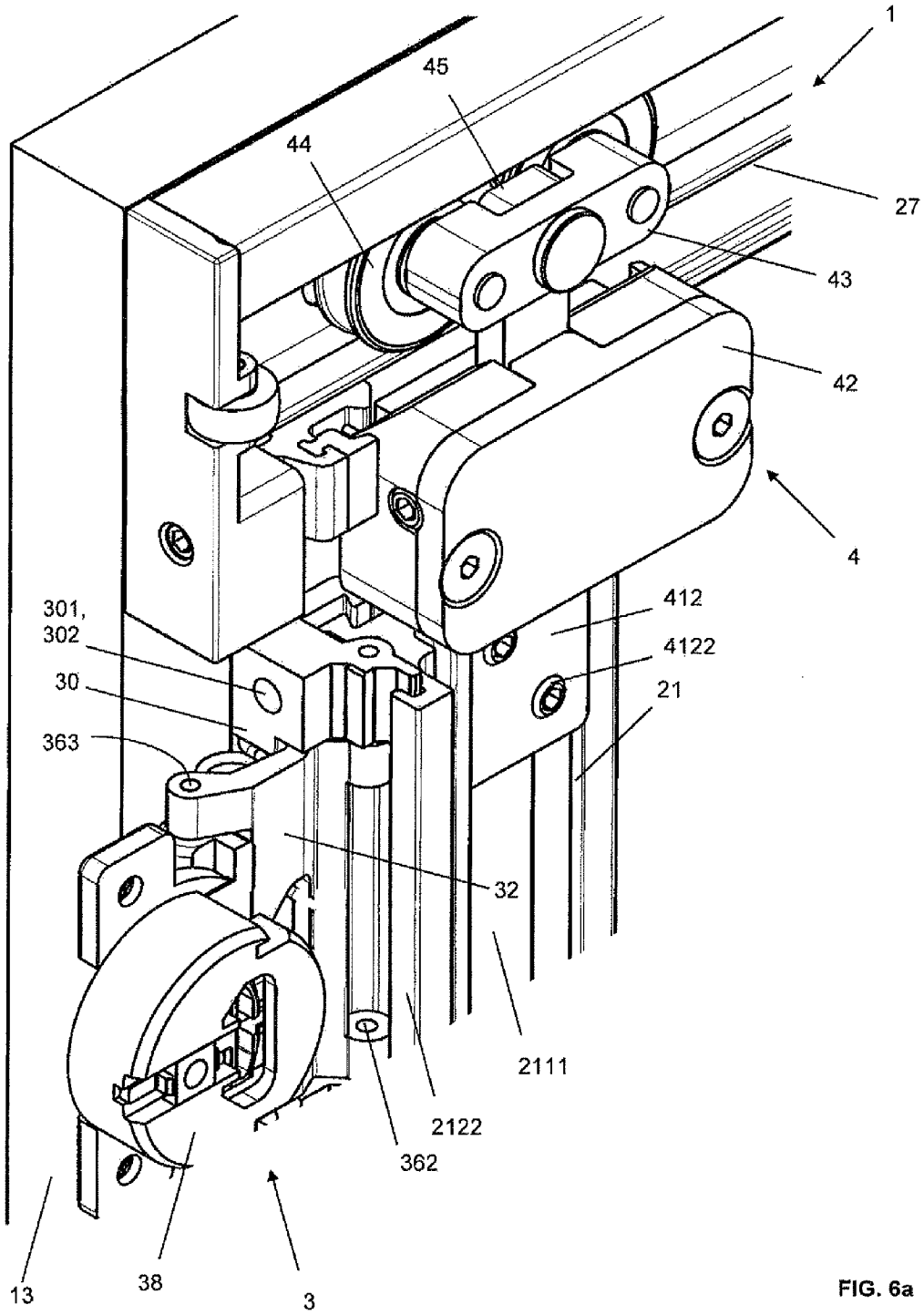
Figure 6B:
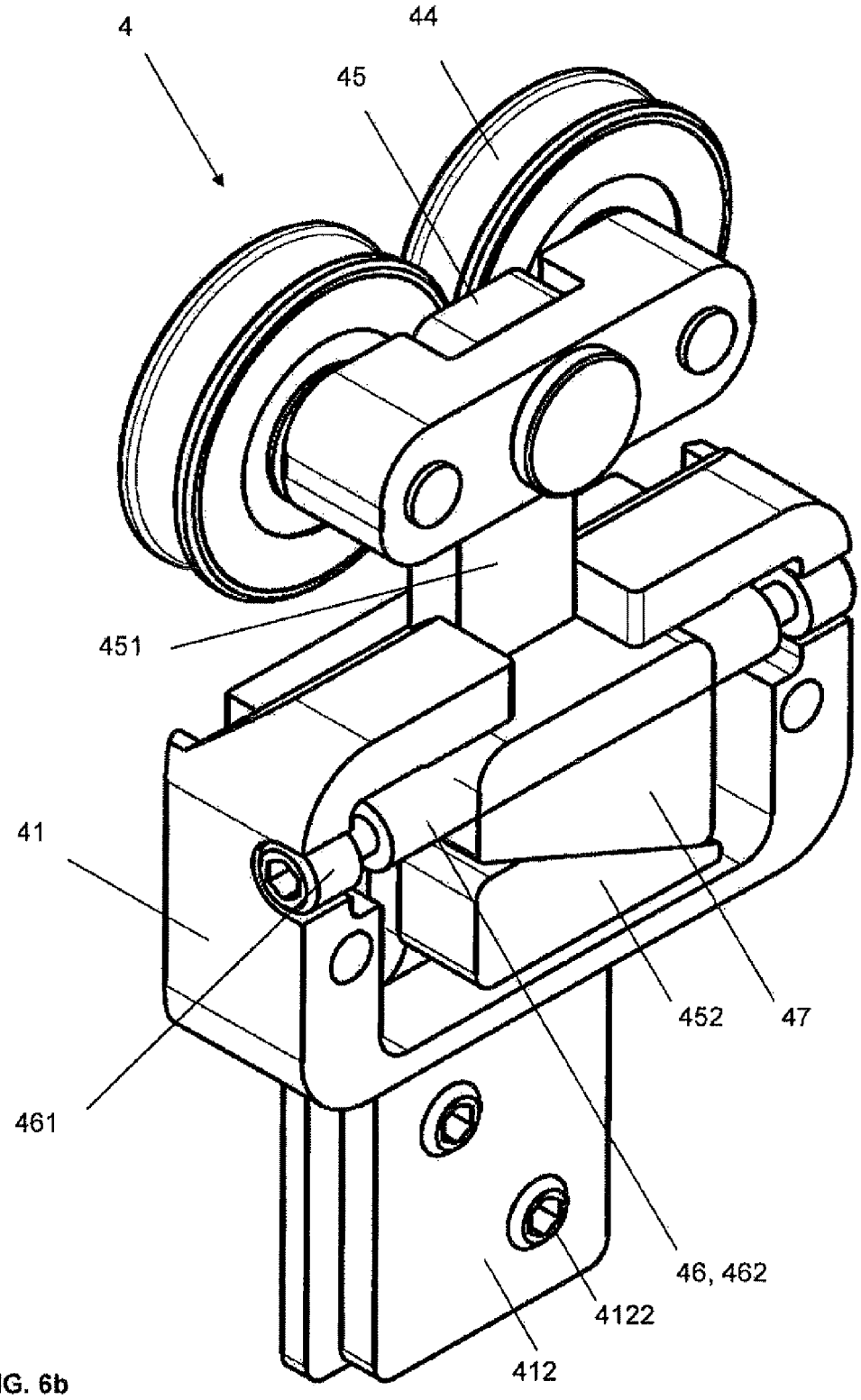
Figure 6C:
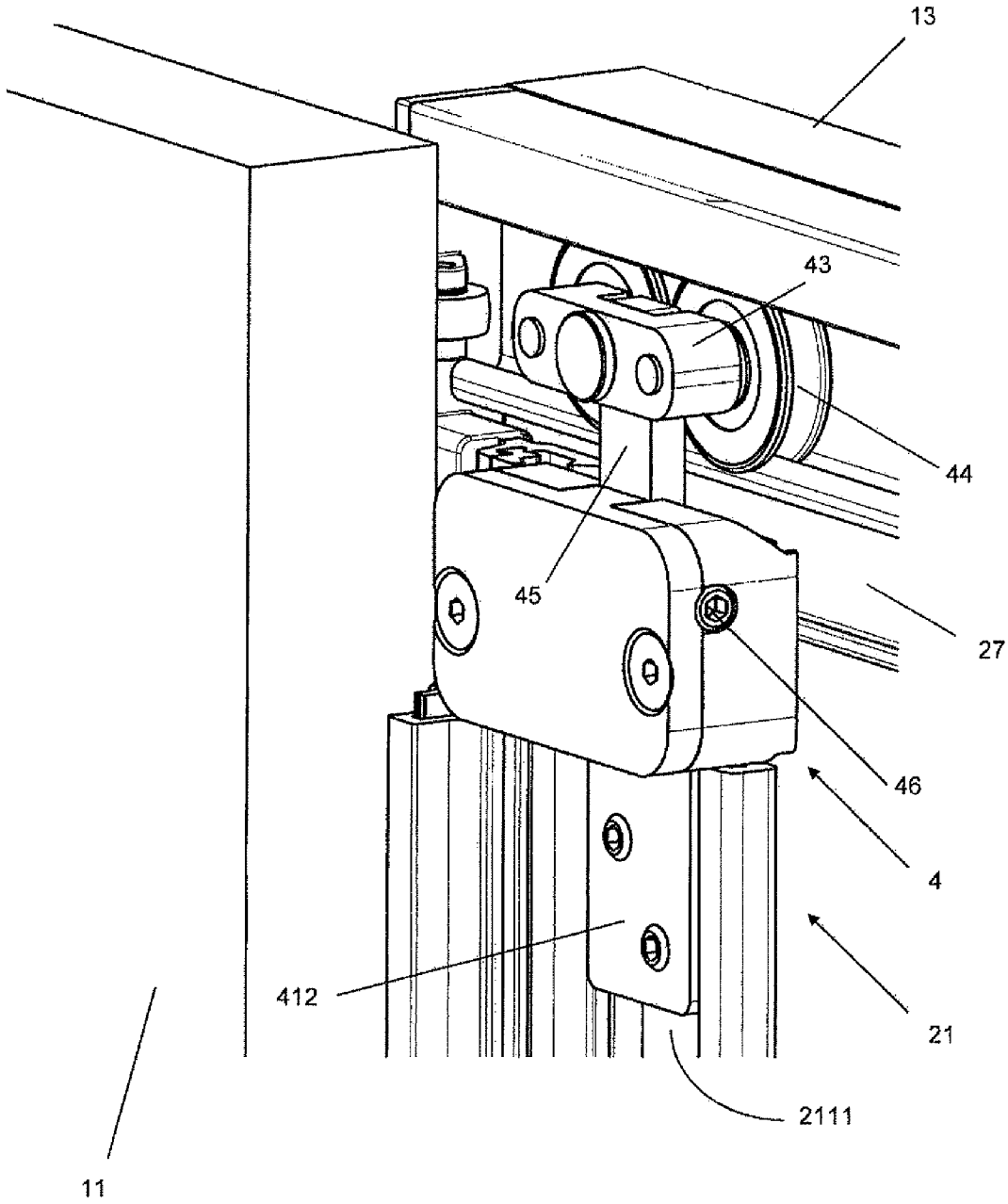
Figure 6D:
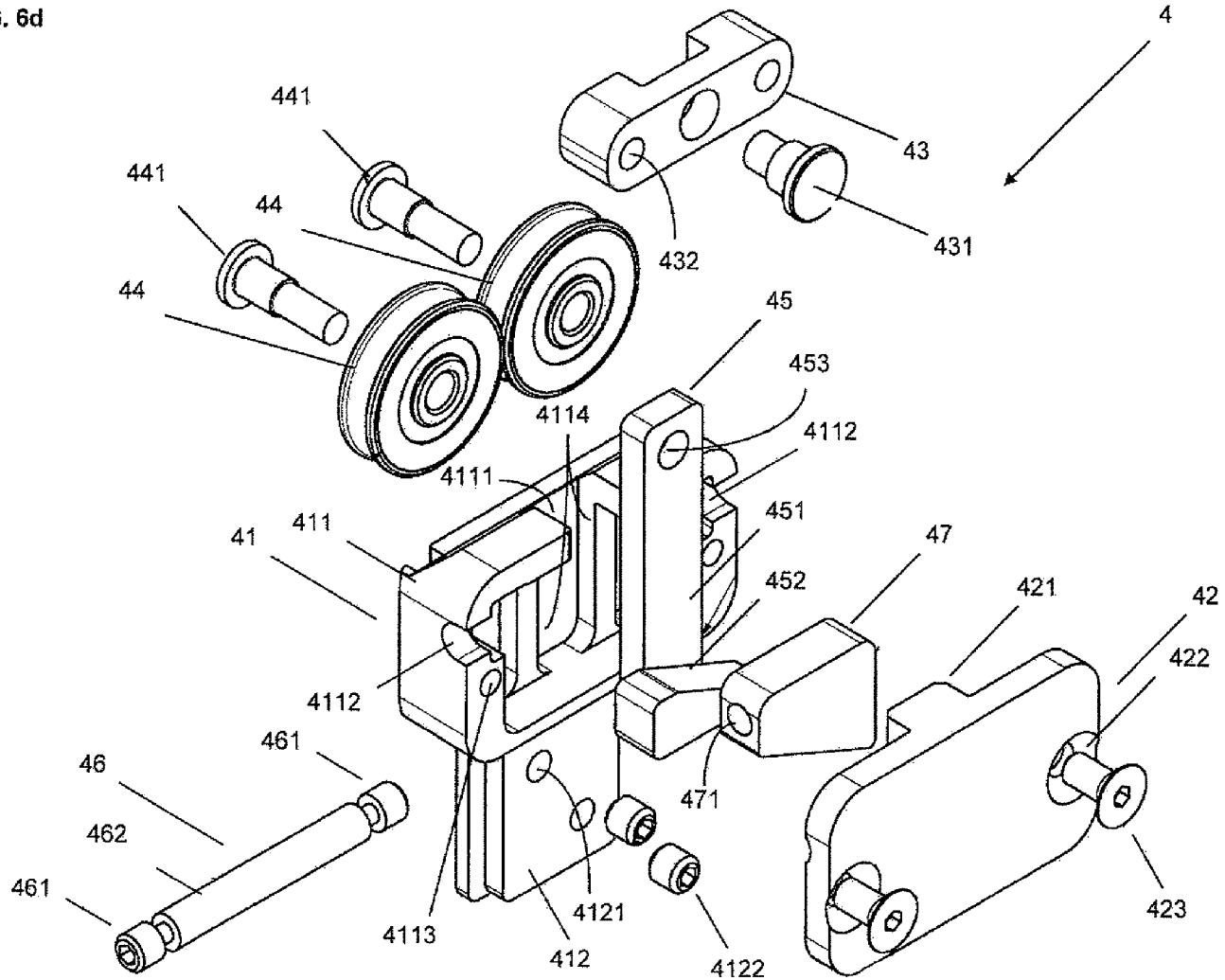
Figure 7A:
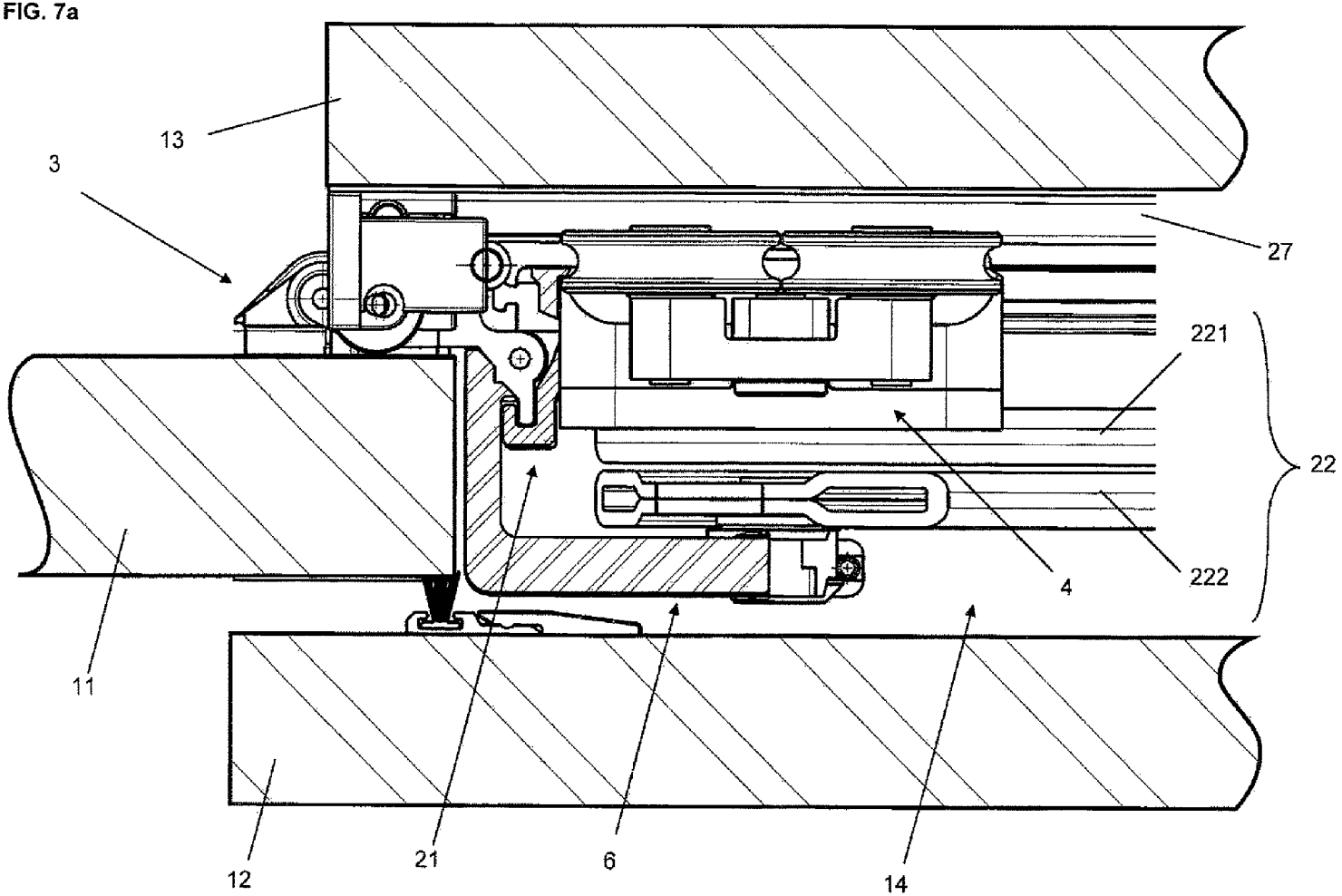
Figure 7B:
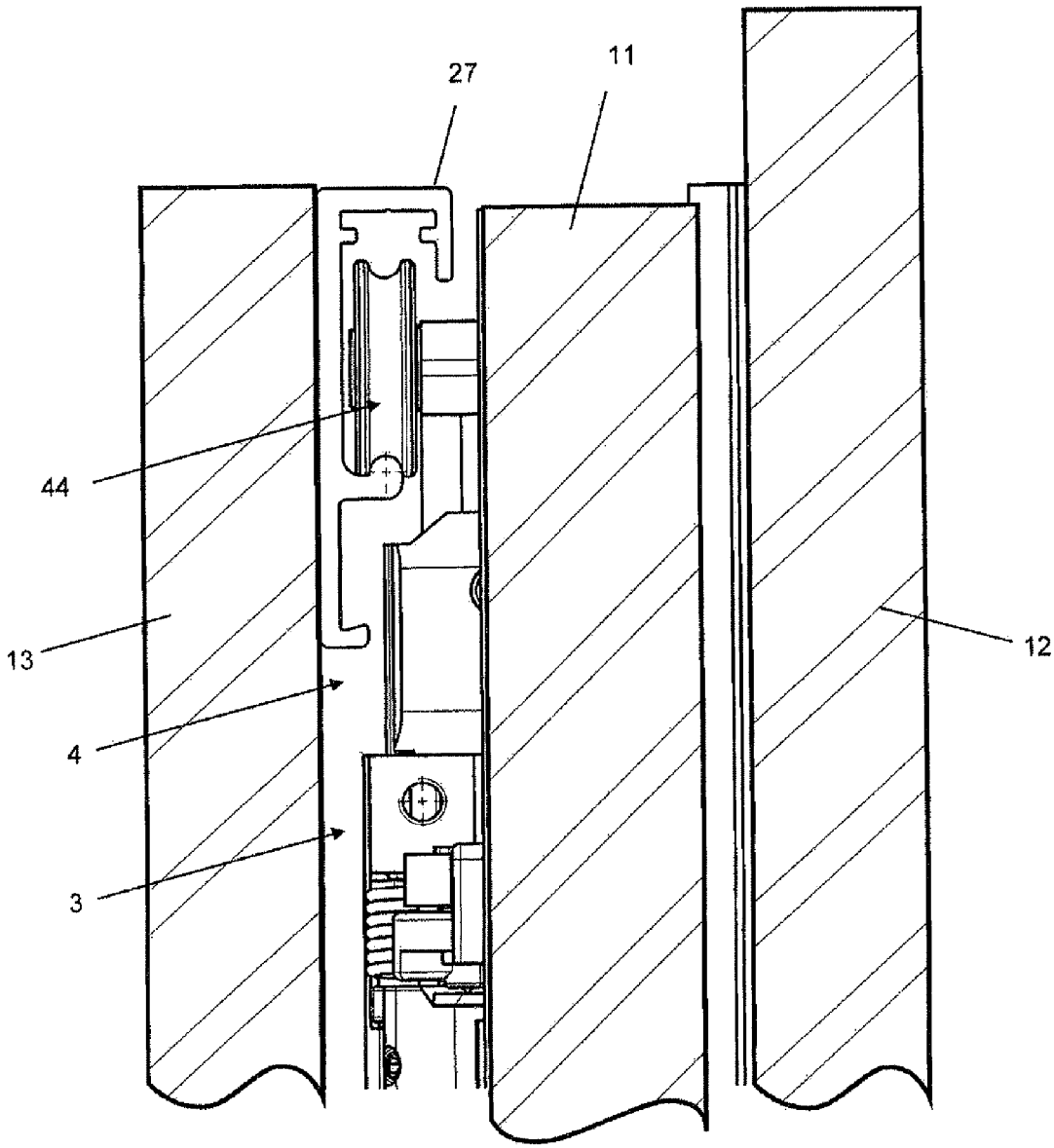
Figure 8:
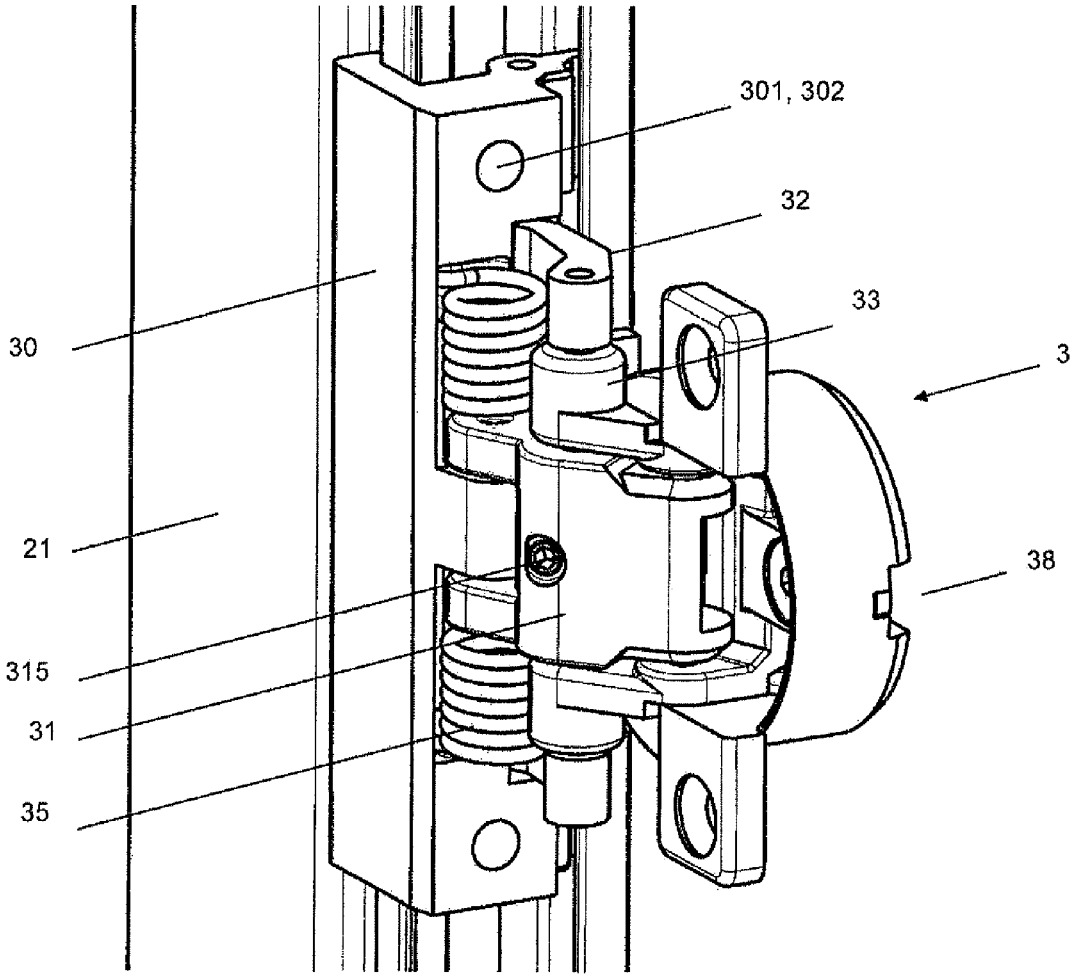
Figure 9:
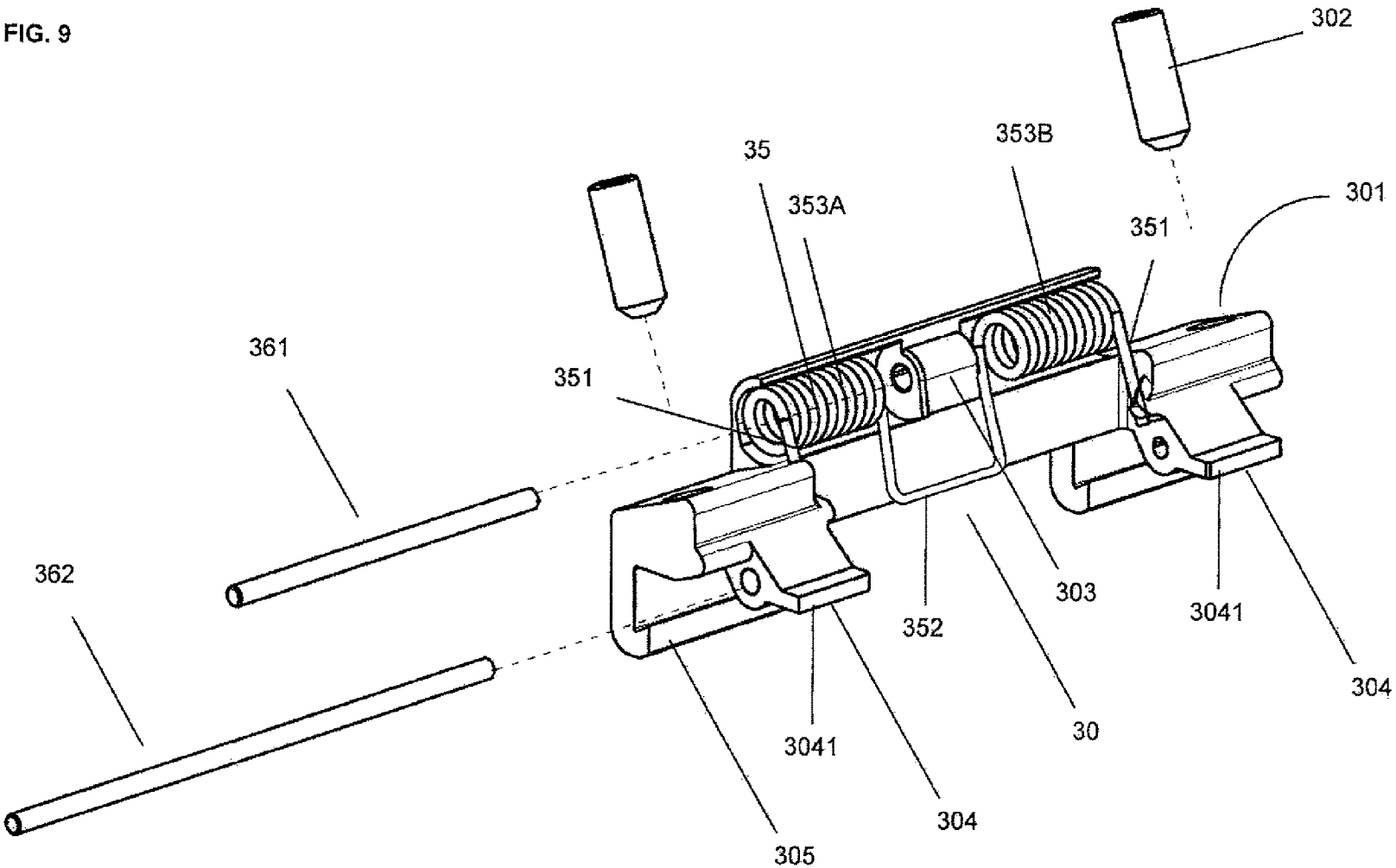
Figure 10A:
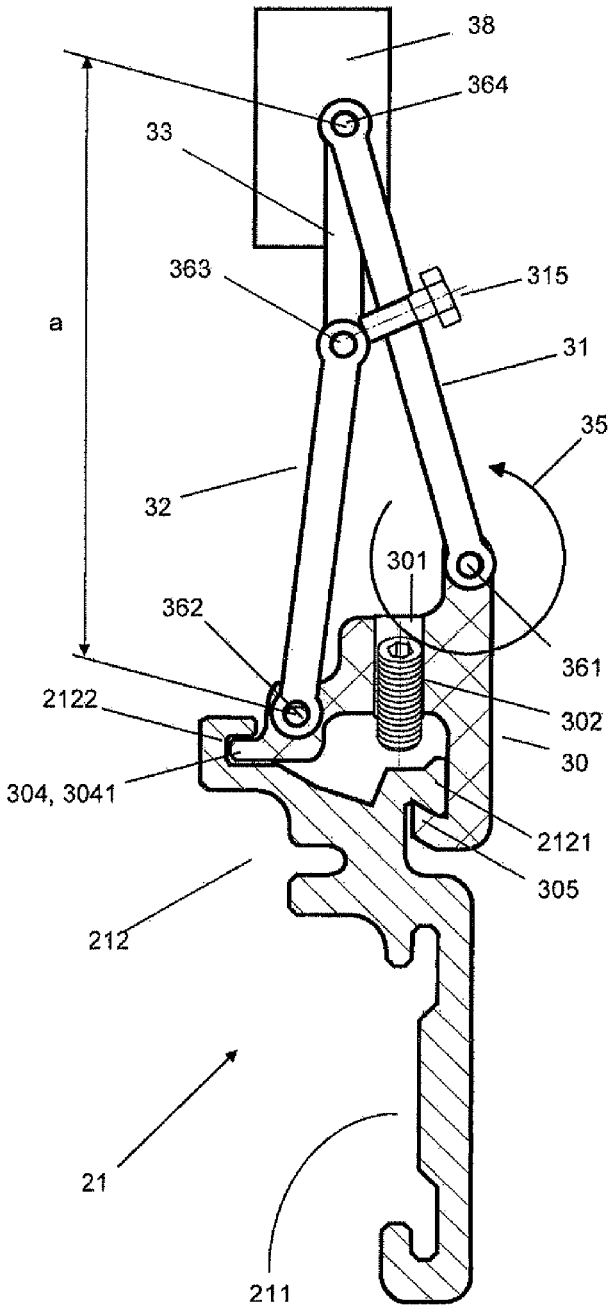
Figure 10B:
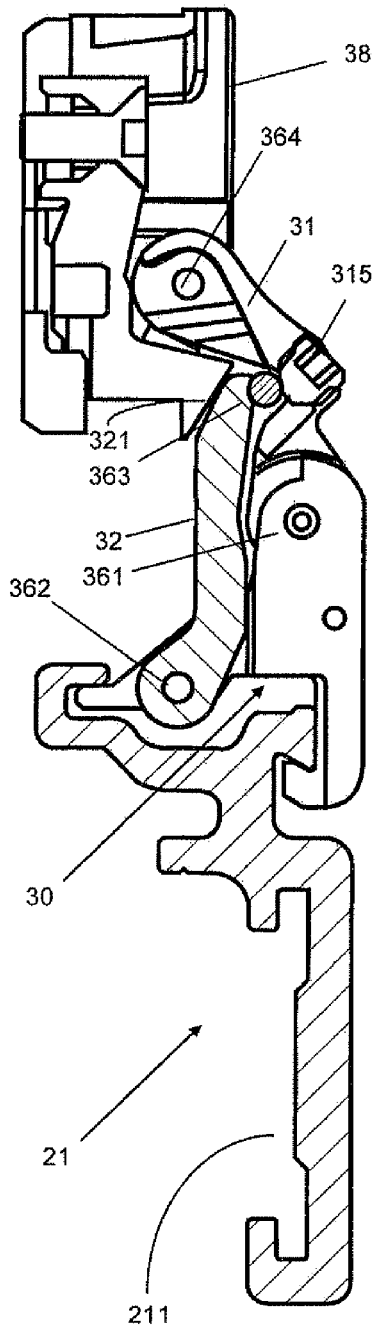
Figures 11A, 11B, 11C:
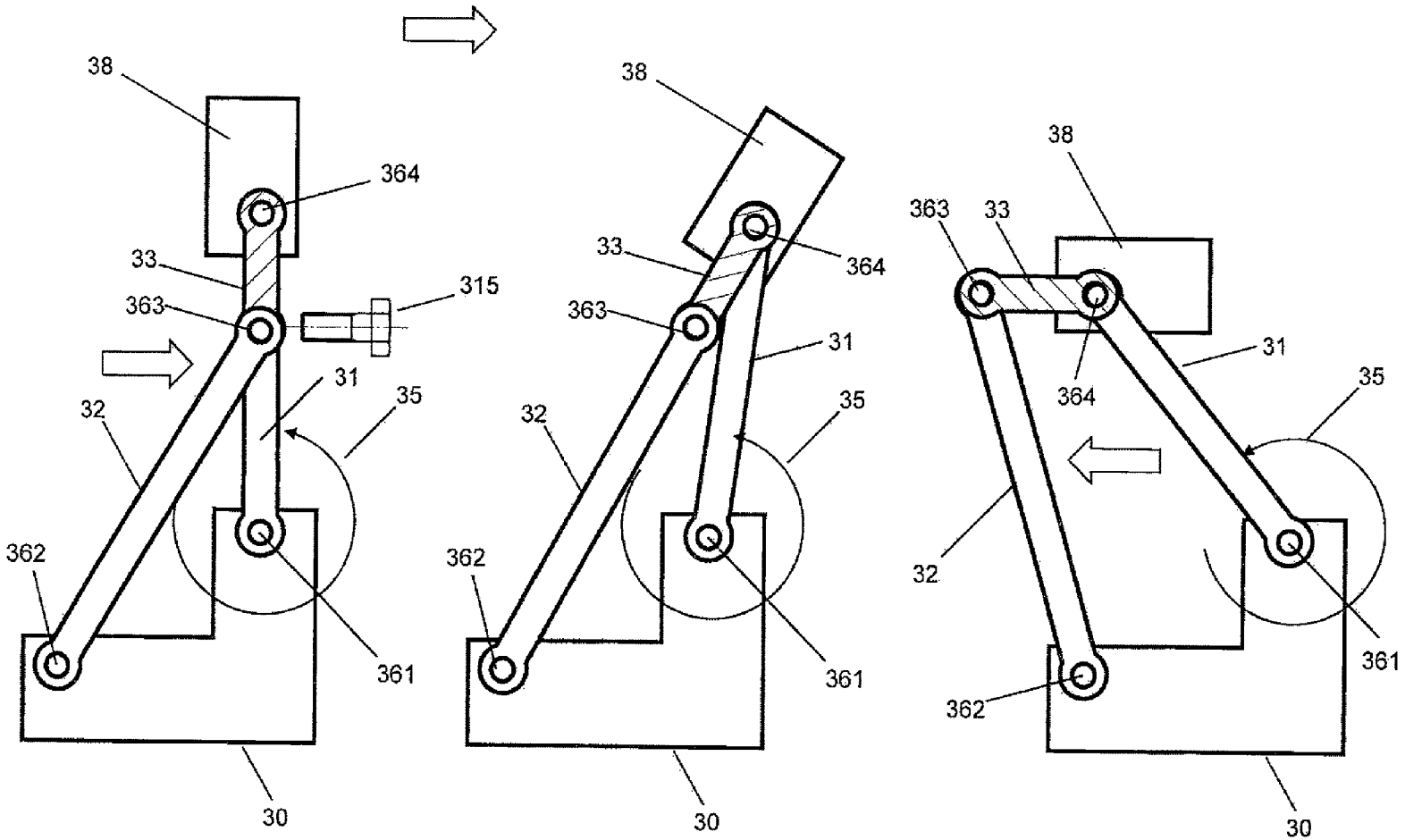
Figure 12A:
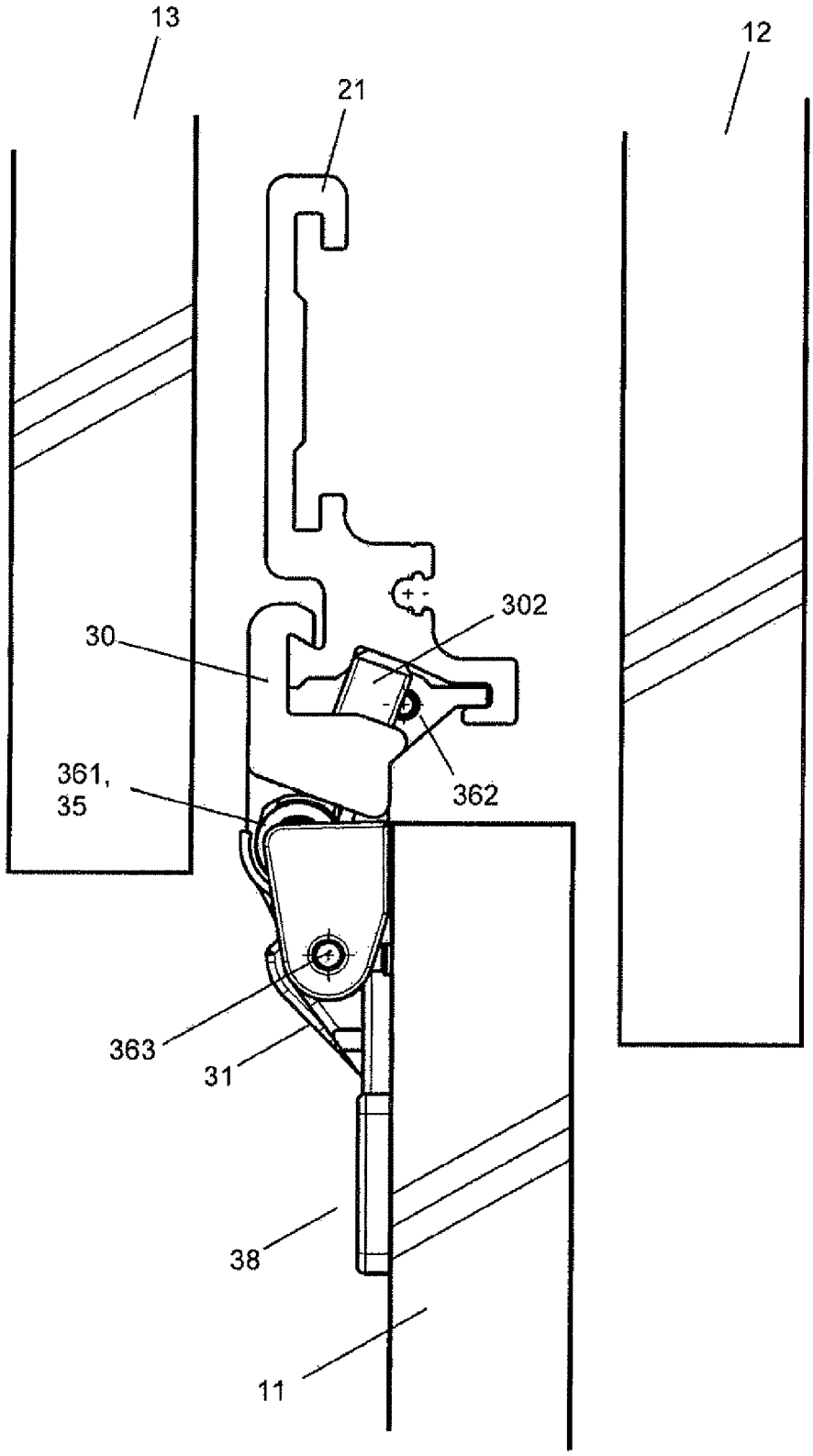
Figure 12B:
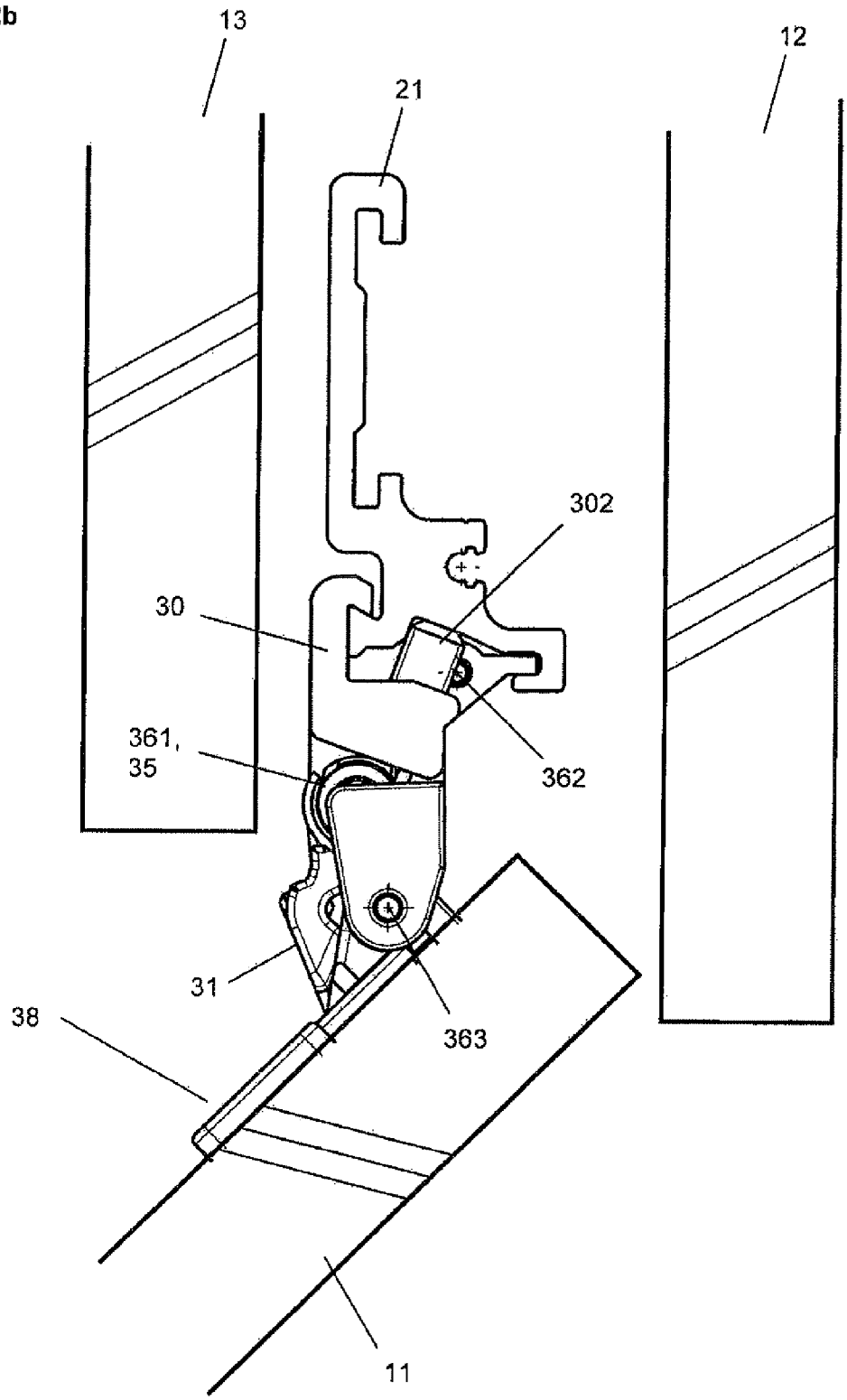
Figure 12C:
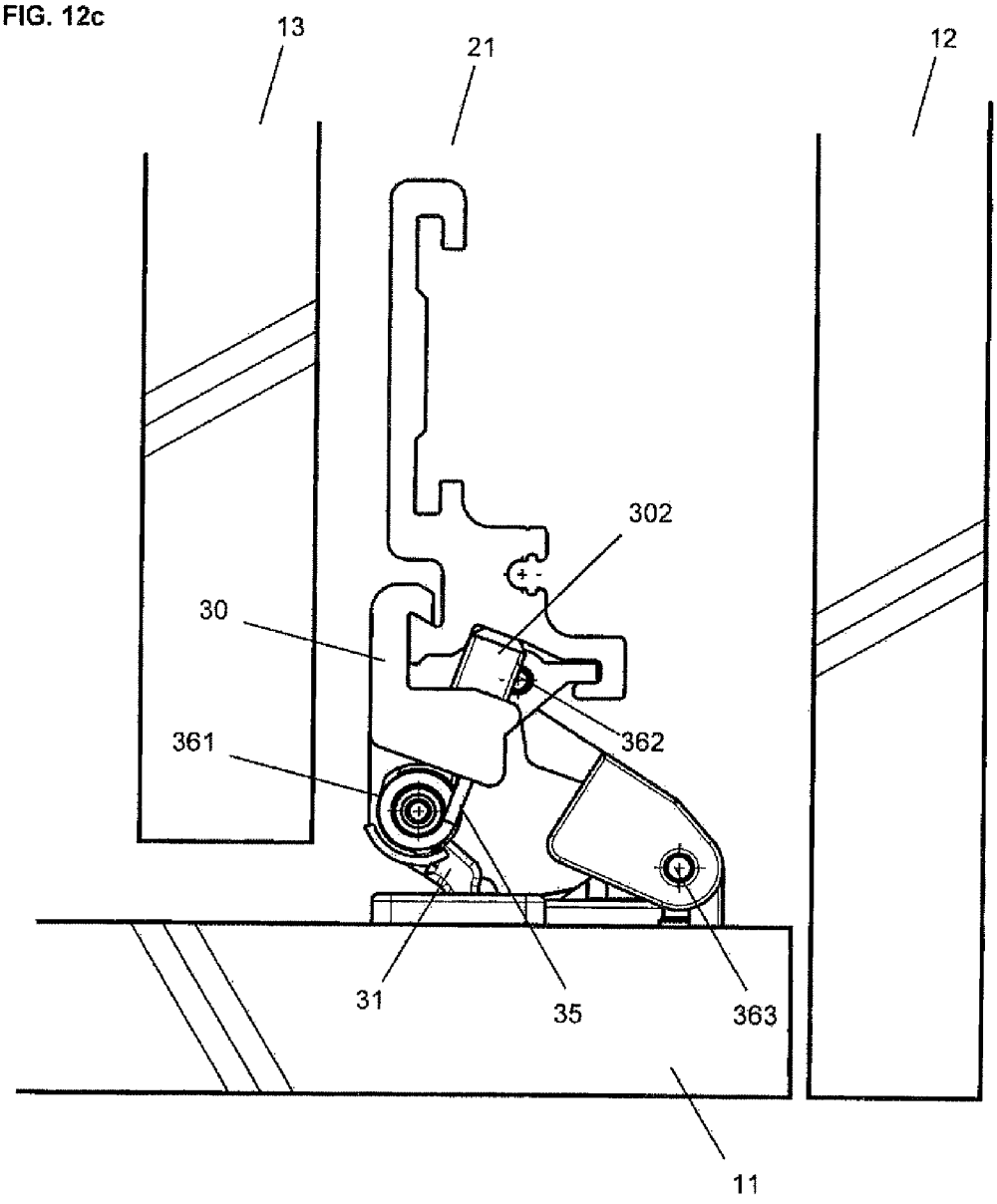
Figure 13:
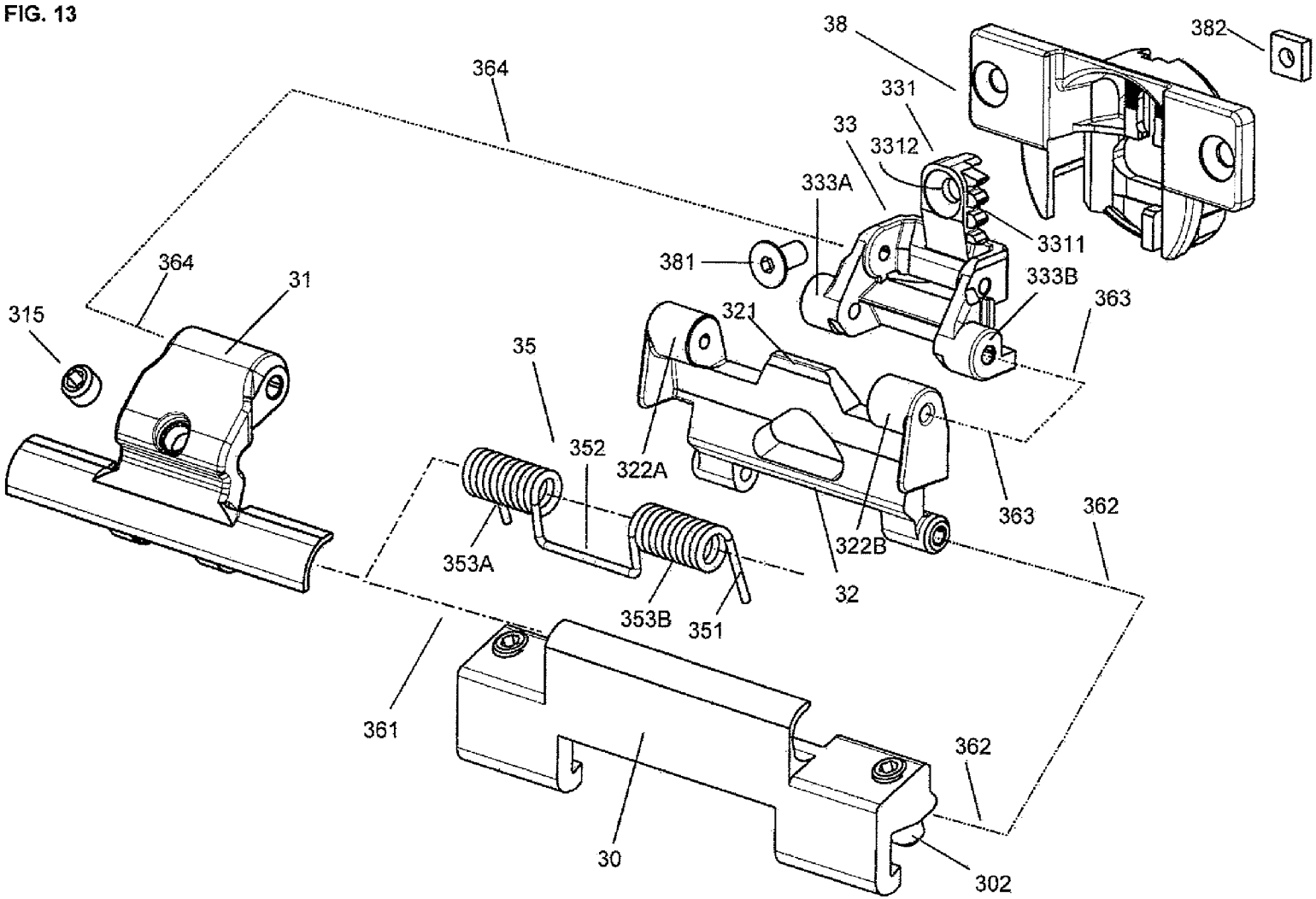
Figure 14A:
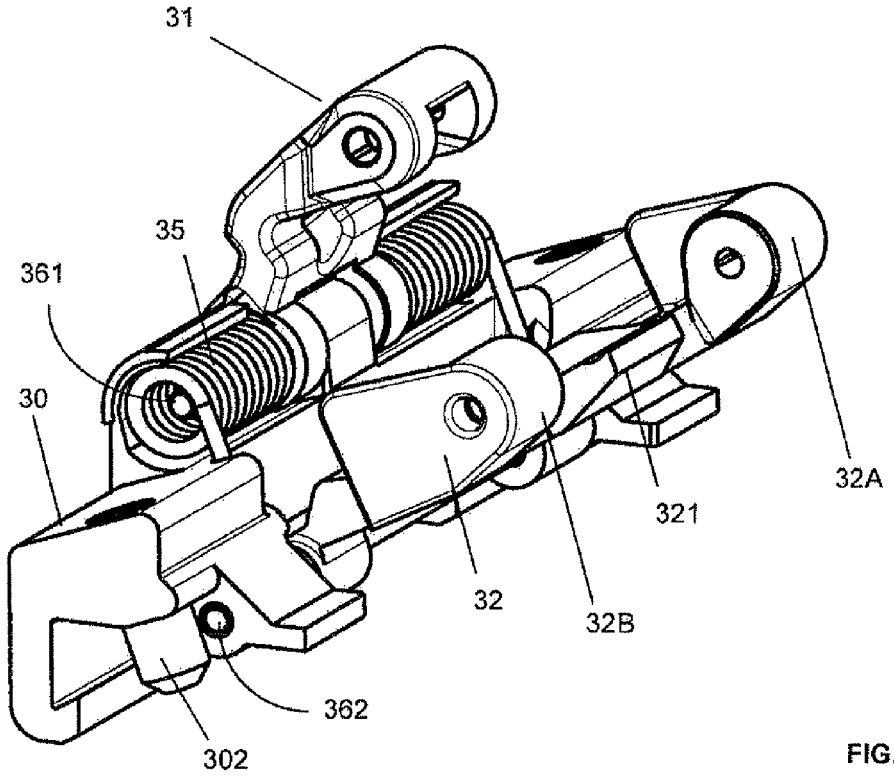
Figure 14B:
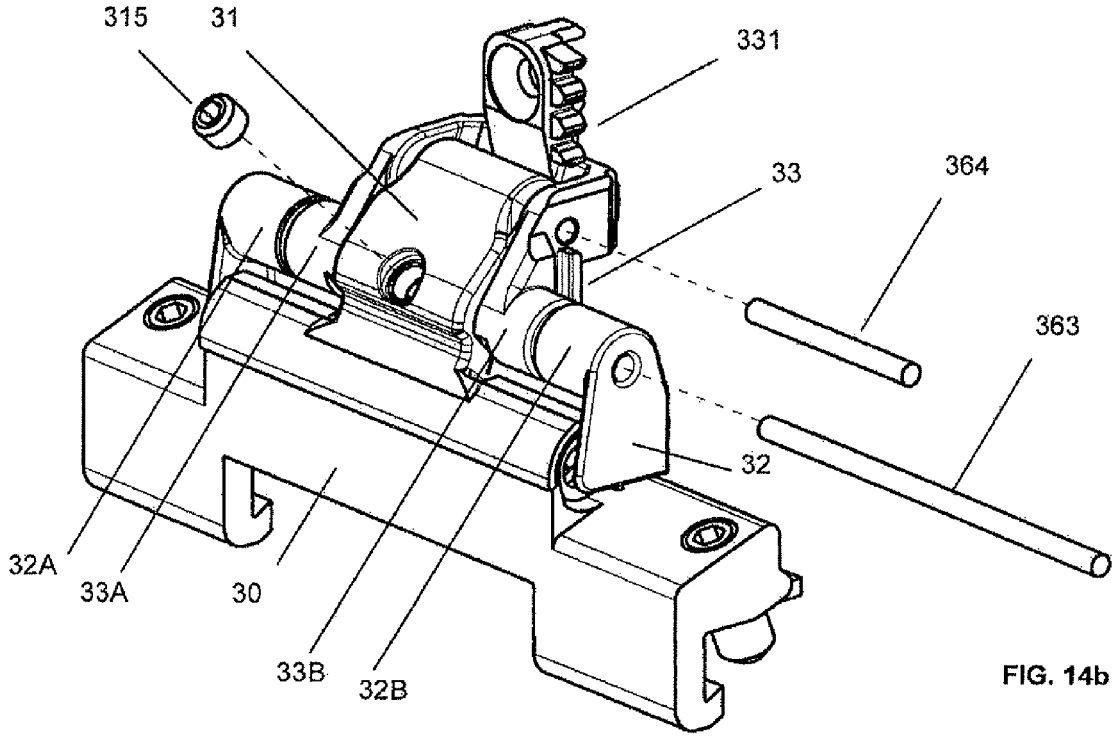
Figure 14C:
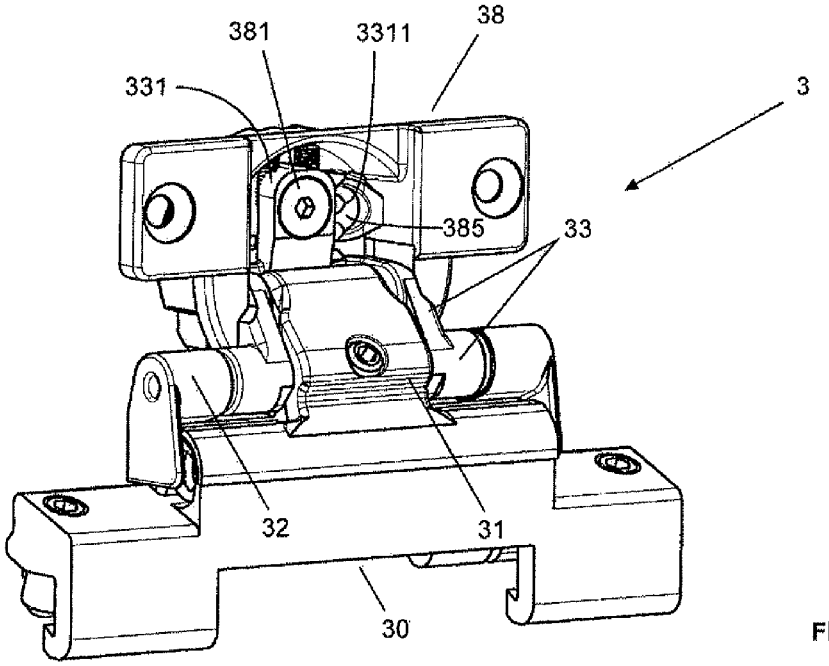
Figure 15A:
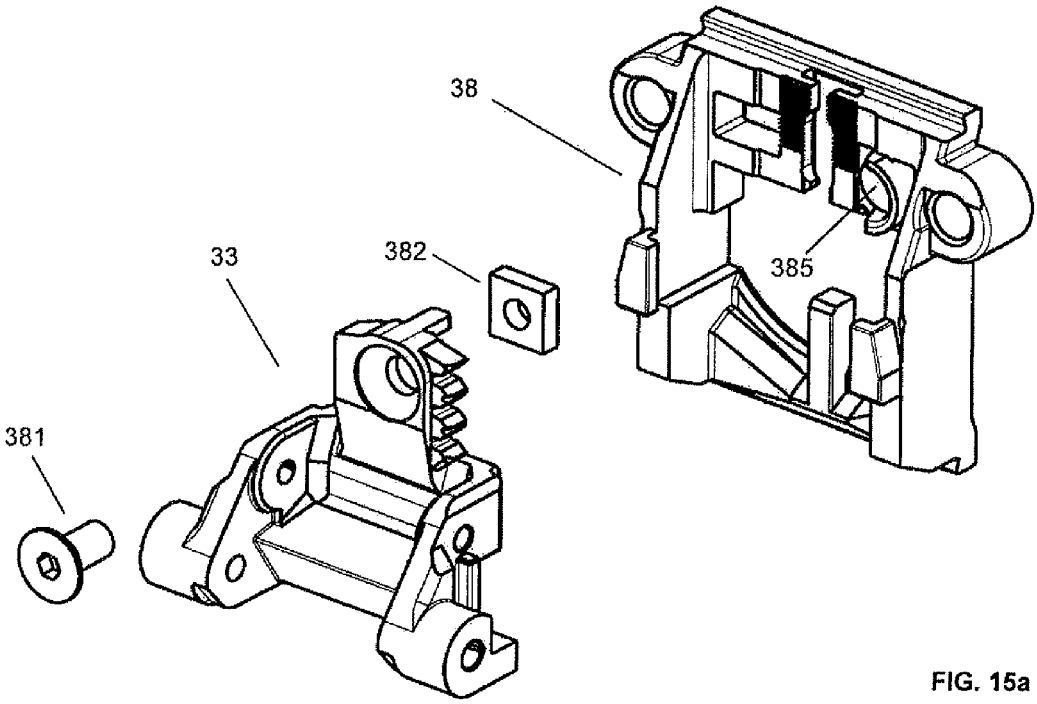
Figure 15B:
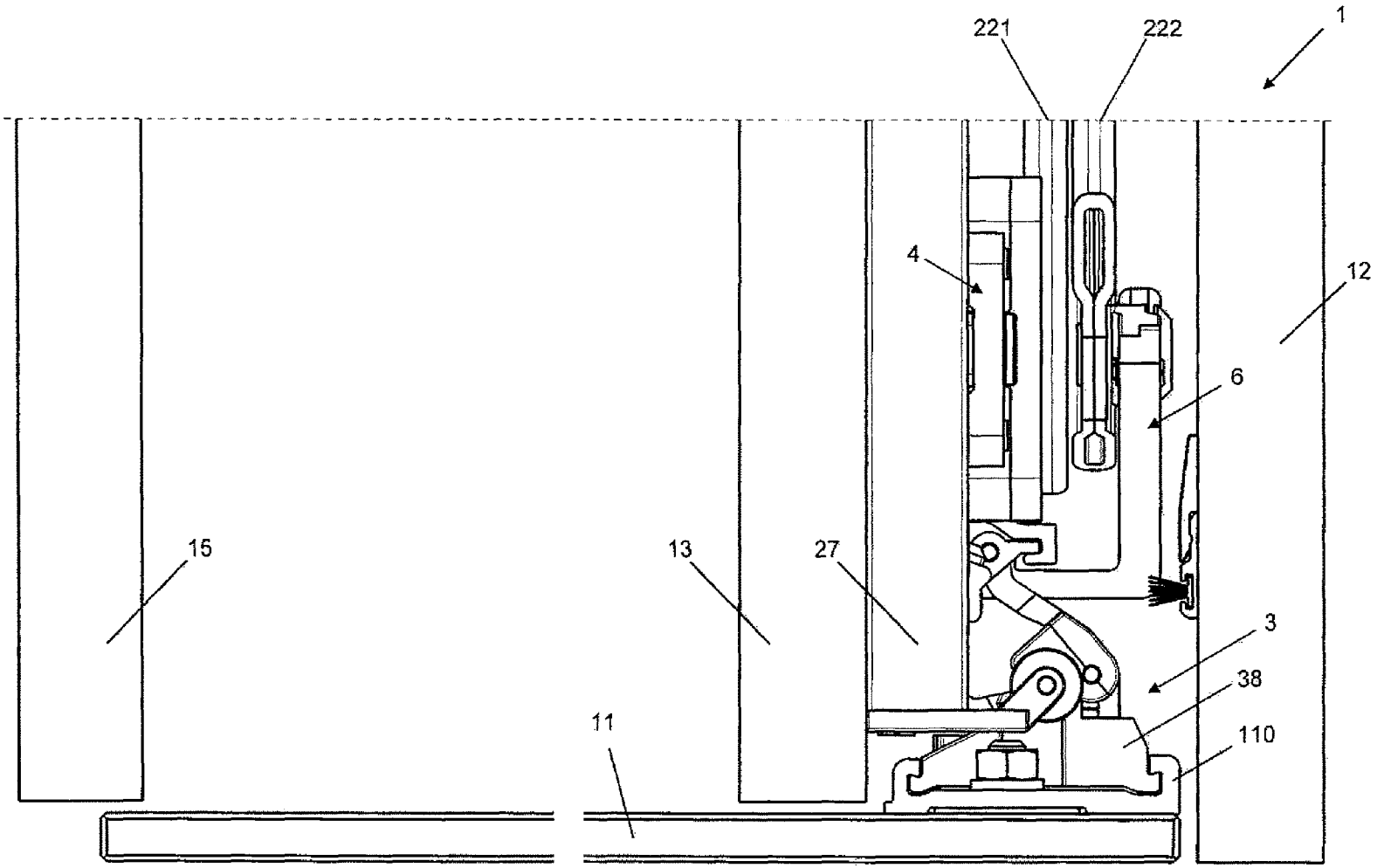

The invention is explained in greater detail below by reference to drawings, in which:

FIG. 1 shows an inventive displacement device 2 integrated into an article of furniture 1, by means of which displacement device 2 a separation element 11 held by five hinges 3 can be displaced into a door compartment 14, which is defined by an outer side wall 12 and an intermediate wall 13 of the article of furniture 1;

FIG. 2 the inventive displacement device 2 with a bracket 21 guided along an upper and a lower rail 27, 28, which bracket 21 is connected on the one hand via the hinges 3 to a separation element 11 and on the other hand to a scissor assembly 22, of which the first and second beams 221, 222 are connected at the upper ends fixedly to anchoring means 23 or to the bracket 21 and are guided at the lower ends in the guide device 24 or in the bracket 21 respectively;

FIG. 3*a* a scissor assembly bearing 6, which can be fixedly connected to the bracket 21, by means of which scissor assembly bearing 6 the upper end of the second rail element 22 is held so that it can be adjusted;

FIG. 3*b* the scissor assembly bearing 6 of FIG. 3*a* in an exploded view;

FIG. 3*c* the assembled scissor assembly bearing 6 of FIG. 3*a* on its own;

FIGS. 4*a, b* a cut-out segment of the bracket 21 in three-dimensional representation;

FIG. 5 the bracket 21 in a sectional view and the scissor assembly bearing 6 connected to the second beam 22, seen from above;

FIG. 6*a* the bracket 21 held by an inventive carriage 4 and guided along a running rail 27, against which bracket 21*a* hinge 3 is mounted;

FIG. 6*b* the carriage 4 of FIG. 6*a* with open carriage housing 411, in which an adjusting wedge 452, which can be displaced horizontally by means of an adjusting screw 46, acts upon a holding wedge 47 coupled with the running wheels 44;

FIG. 6*c* the carriage 4 and the bracket 21 of FIG. 6*a* with a mounted separation element 11 seen from another direction;

FIG. 6*d* the carriage 4 of FIG. 6*b* in an exploded view;

FIG. 7*a* in part, the bracket 21 connected by means of hinges 3 to the separation element 11 as well as to the scissor assembly bearing 6 and the carriage 4, as seen from above;

FIG. 7*b* the device of FIG. 7*a*, as seen from the front;

FIG. 8 an inventive hinge 3 in an opened position, with a mounting part 30 mounted on the bracket 21, which mounting part 30 is connected on the one hand via a drive lever 31 driven by a drive spring 35 and on the other hand via an adjusting lever 32 and a mounting lever 33 to a hinge cup 38;

FIG. 9 the mounting part 30 of FIG. 8 with a first bearing body 303 serving to hold a first bearing shaft 361 and two second bearing bodies 304 serving to hold a second bearing shaft 362;

FIG. 10*a* in a principle diagram, the inventive hinge 3 with the mounting part 30 mounted on the bracket 21, and with the drive lever 31 driven by the drive spring 35, the adjusting lever 32 and the mounting lever 33;

FIG. 10*b* the inventive hinge 3 of FIG. 10*a* in a concrete embodiment;

FIGS. 11*a-c* in a principle diagram, the hinge 3 of FIG. 10*a* with the lever mechanism in an open position (FIG. 11*a*), in a transitional position (FIG. 11*b*) and in a closed position (FIG. 11*c*);

FIG. 12*a-c* the concretely shown hinge 3 of FIG. 8 in an open position (FIG. 12*a*), in a transitional position (FIG. 12*b*) and in a closed position (FIG. 12*c*);

FIG. 13 the inventive hinge 3 in an exploded view with connection lines, which represent the insertion of the first, second, third and fourth bearing shaft 631, 632, 633, 634;

FIG. 14*a* the mounting part 30 of FIG. 9 with inserted first bearing shaft 361, through which the drive spring 35 and the drive lever 31 are held, and with inserted second bearing shaft 362, through which the adjusting lever 32 is held;

FIG. 14*b* the mounting part 30 with the drive lever 31 and the adjusting lever 32, on the free-lying end elements of which the third and fourth bearing shaft 363, 364 are inserted in order to mount the mounting lever 33;

FIG. 14*c* the completely assembled hinge 3 with the mounting element 38 connected to the mounting lever 33, which mounting element 38 is formed as a hinge cup;

FIG. 15*a* the mounting lever 33 with a mounting element 38, which is formed as a fitting for a glass door 11; and FIG. 15*b* an article of furniture 1 with a glass door 11, which is held by an inventive displacement device 2.

FIG. 1 shows an inventive displacement device 2 integrated into an article of furniture 1, by means of which displacement device 2 a separation element 3 held by five hinges 3 can be displaced into a door compartment 14, which is defined by an outer side wall 12 and an intermediate wall 13 of the article of furniture 1.

FIG. 2 shows the inventive displacement device 2 with a bracket 21 guided along an upper and a lower rail 27, 28, which bracket 21 is connected on the one hand via the hinges 3 to the separation element 11 and on the other hand is held in vertical position by a scissor assembly 22.

The scissor assembly 22 comprises two first and second beams 221, 222 connected to each other in the middle by a joint bolt 223. The upper end element of the first beam 221 is connected pivotally with anchoring means 23, which are fixed to the side wall 12 or the intermediate wall 13. The lower end element of the first beam 221 is mounted so as to be vertically displaceable by means of a guide profile 26 for example in the bracket 21. The upper end element of the second beam 222 is pivotally held by means of a scissor assembly bearing 6, which can be displaced along the bracket 21 and fixed at any point by means of mounting bolts. The lower end element of the second beam 22 is displaceably mounted in a guide device 24, which is fixed to the side wall 12 or to the intermediate wall 13. In principle it would also be possible to pivotally hold the lower end elements of the crossed beams 221, 222 and to mount their upper end elements so as to be displaceable.

It can further be seen from FIG. 2 that the displacement device 2 can be fixed not only to the wall of an article of furniture 1, e.g. a cupboard, but also to any wall, for example the wall of a building, in order to close off an opening or to position the separation element parallel to the building wall. The lower and upper running rail 27, 28 are used in particular if the displacement device 2 is connected to heavy separation elements 11. In case of lighter separation elements 11 the running rails 27, 28 are not normally used.

In the inventive displacement device 2 an adjustment of the anchoring means 23 installed within the door compartment 14 is no longer necessary. All necessary settings can be carried out on the scissor assembly bearing 6, which is shown in FIGS. 3*a*, 3*b* and 3*c*.

FIG. 3*a* shows the scissor assembly bearing 6 fixedly blocked with the bracket 21 by means of mounting bolts 64. By means of the scissor assembly bearing 6 the upper end of the second rail element 222 is held in an adjustable way.

As shown in FIG. 3*b*, the scissor assembly bearing 6 comprises a profile body 61 with a first, second and third profile part 611, 612, 613, through which a U-shaped profile is formed at least approximately, said U-profile enclosing the bracket 21 at least in part. On the first profile part 611 and on the second profile part 612 a holding claw 6121, i.e. a holding strip 612 are provided, which can engage in the bracket 21. Furthermore two threaded bores 6122 are provided on the left side of the second profile part 612, into which threaded bores 6122 said mounting bolts 67 can be turned towards the bracket 21 in order to fix the profile body 61 of the scissor assembly bearing 6 (see FIG. 3*a*).

The third profile part 6123 comprises on the upper side a mounting opening 6131 serving to receive a mounting shaft 64, opposite which mounting opening 6131 the third profile part 613 comprises a foot element 6133, in which a guide channel 61331 is provided. Furthermore approximately in the middle region of the third profile part 613 a threaded channel 6132 extending perpendicular to the second profile part 612 is provided, which threaded channel 6132 serves to receive the threaded shaft 632 of an adjusting bolt 63. By means of the adjusting bolt 63 an adjusting lever 62 held pivotally by the mounting shaft 64 can be moved forward and back. For this purpose the threaded bolt 63 comprises at the end facing the adjusting lever 62 a head 631, which is held in a receiving opening 622 provided on the adjusting lever 62, as shown in FIG. 3*c*. On the other side the adjusting bolt 63 comprises a tool opening 633, for example a hexagon opening, into which a hex tool can be introduced in order to rotate the adjusting bolt 63 and to pull the adjusting lever 62 forwards or push it back. The tool, for example a screwdriver, can be introduced from the front side of the article of furniture 1, possibly through a part of the threaded channel 6132, into the tool opening 633. The setting of the adjusting lever 62 can therefore be carried out comfortably from the front side of the article of furniture 1.

The adjusting lever 62 comprises on its upper side a mounting opening 622, into which the mounting shaft 64 is introduced. On the lower side the adjusting lever 62 comprises a mounting lug 621, through which a bearing screw 68 is guided, which is carried by the upper end element of the second beam 222, as shown in FIG. 3*a*.

Through the setting of the adjusting lever 62 the upper side of the bracket 21 is pulled towards the upper end element of the second beam 22 or pushed so far away from it until the desired inclination of the bracket 21 is set. In order to ensure that height changes of the mounting lug 621 of the adjusting lever 62, which arise upon changes in the inclination of the bracket 21, do not lead to a locking of the bearing screw 68, the mounting lug 621 comprises an elongated opening, within which the shank of the bearing screw 68 can move.

In order that the adjusting lever 62 constantly remains held in a plane, a guide nose 624 is provided on the lower side of said adjusting lever 62, which guide nose 624 engages in the guide channel 61331 in the foot element 6133 of the third profile part 613.

It is further shown in FIGS. 3*b* and 3*c* that the guide channel 61331 can be closed at the end of the foot element 6133 by means of a stop bolt 66 so that the latter forms an outer stop for the nose 624 of the adjusting lever 62.

FIG. 3*c* shows the assembled scissor assembly bearing 6 of FIGS. 3*a* and 3*b* standing alone with the inserted adjusting lever 62, which is held by the adjusting bolt 63 in a desired position.

Figure 4B:
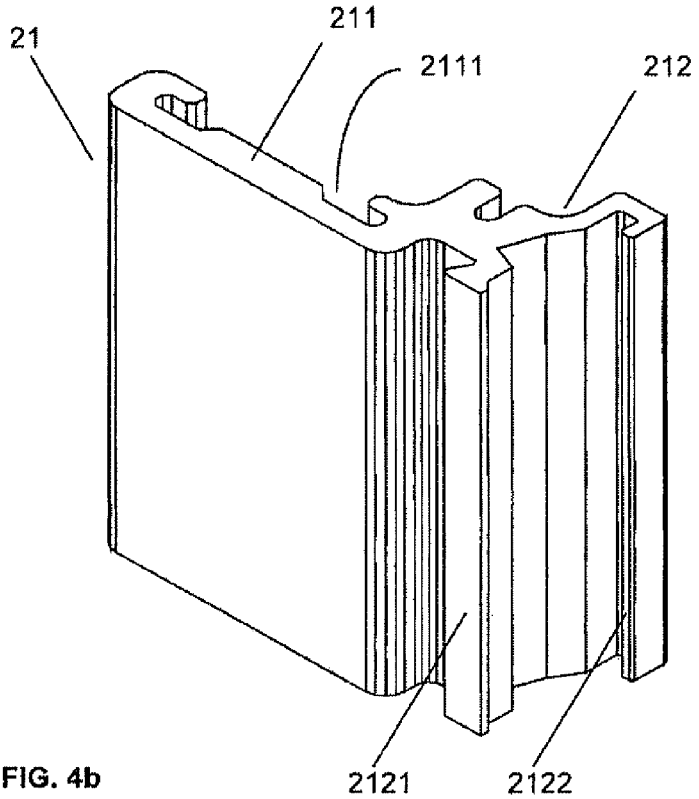

FIGS. 4*a* and 4*b* show in a three-dimensional representation a cut-out segment of the bracket 21, which serves on the one hand to hold the hinges 3 and the scissor assembly bearing 6 and on the other hand to hold a carriage 4 guided by the upper running rail 28 and the guide profile 26, which is connected to the lower end element of the first beam 221.

For this purpose the bracket 21 comprises a first mounting profile 211 with a mounting channel 2111, which serves to receive the guide profile 26 and a mounting part 412, which is formed on the lower side of the carriage body 41 of the carriage 4 (see for example FIG. 6*b*). The first mounting profile 211 is formed for example as a C-shaped profile, into which the mounting part 412, formed complementarily thereto, of the carriage 4 and the guide profile 26 can preferably be inserted in a clearance free way. As shown in FIGS. 6*a* and 6*d*, the mounting part 412 comprises threaded bores 4121, into which mounting bolts 4122 can be introduced, which are turned towards the bracket 21 and preferably comprise on the front side a cupped gripping point in order to hold the carriage 4 in a shape locking way.

The first mounting profile 211 of the one-piece bracket 21 is connected to a second mounting profile 212, which serves to hold the hinges 3 and the scissor assembly bearing 6, which can be displaced along this second mounting profile 212 and can be fixed at any desired point. For this purpose the second mounting profile 212 comprises a mounting strip 2121 and a mounting groove 2122, which cooperate with mounting elements 304, 305; 6111, 6122 of the hinge 3 and the scissor assembly bearing 6 and can be tensioned in relation thereto by means of mounting bolts 302, 67 (see FIG. 3*b* and FIG. 10*a*).

FIG. 5 shows the bracket 21 in a sectional representation and the scissor assembly bearing 22 connected to the second beam 222, seen from above. It is shown that the profile body 61 of the scissor assembly bearing 61 cooperates with the second mounting profile 212 of the bracket 21 and, with a holding claw 6111, surrounds the mounting strip 2121 of the bracket 21 and, with a holding strip 6121, engages in the mounting groove 2122 of the bracket 21. Furthermore a threaded bolt 67 is shown, which presses against the second mounting profile 212 so that the profile body 61 of the scissor assembly bearing 6 cannot be released from the bracket 21.

FIG. 5 further shows that guide rollers of a guide device 8 are guided in a guide channel 281 of the lower guide rail 281. The bracket 21 is thus held by the scissor assembly 22 in a first plane and by the carriage 4 and the guide device 8 in a second plane perpendicular thereto.

FIG. 6*a* shows the bracket 21 held by an inventive carriage 4 and guided along the upper running rail 27, on which bracket 21*a* hinge 3 is mounted.

FIG. 6*b* shows the opened carriage 4 of FIG. 6*a* with a view of the adjusting elements 45, 46 and 47 provided therein.

FIG. 6*c* shows the carriage 4 and the bracket 21 of FIG. 6*a* with mounted separation element 11 from a different direction.

FIG. 6*d* shows the carriage 4 of FIG. 6*b* in an exploded view.

The carriage 4 comprises a carriage body 41 with a carriage housing 411, in which an adjusting element 45 is mounted so as to be displaceable in height. Said adjusting element 45 consists of a vertically orientated holding bar 451 and a holding wedge 452 fixed to the lower side of the holding bar 451. On the upper side of the holding bar 451*a* bearing opening 451 is provided, into which a central axle 431 can be introduced, which pivotally holds a support lever 43 in the middle. The support lever 43 comprises on each of its two sides a receiving opening 432, in which the axles 441 of running wheels 44 are held. The support lever 43 thus serves as a rocker element, which follows the inclination of the running rail 27 and distributes the load evenly on both running wheels 44.

The holding bar 451 is held in the housing 411 of the carriage body 41 between two guide beams 4114 so as to be vertically displaceable and projects outwards through a housing opening 4111. Between the two guide beams 4114 the holding bar 453 is held by means of a bearing block 421, which is arranged on the lid 42 of the carriage housing 411. On the housing lid 42 receiving openings 422 for end screws 423 are provided, whereby said end screws 423 can be rotated in threaded bores 4113 in the carriage body 41. After the fixing the holding bar 451 is thus held so as to be vertically displaceable.

Furthermore an adjusting screw 46 is provided in the carriage housing 411, which adjusting screw 46 comprises at both ends a screw head 461 and between them a screw shank 462 with a thread. The two screw heads 461 are rotatably held in bearing openings 4112, which are provided in sides of the carriage housing 411 lying opposite each other. The bearing openings 4112 lie at the same height and the adjusting screw 46 is thus orientated horizontally and at the same time perpendicularly to the displacement direction of the holding bar 451.

The screw shank 462 of the adjusting screw 46 is turned into a threaded channel 471, which runs completely through an adjusting wedge 47. The adjusting wedge 47 thereby lies above the holding wedge 452, whereby two wedge faces inclined against the horizontal lie against each other as soon as the holding bar 451 is drawn upwards. Through the rotation of the adjusting screw 46 the adjusting wedge 47 moves in horizontal direction from one side to the other of the carriage housing 411, whereby the holding wedge 452 is displaced downwards or, under load, upwards.

In this way the height of the carriage body 41 and of the bracket 21 connected thereto with the aid of the mounting part 412 can be precisely set. The adjusting screw 46 can be manipulated from two sides of the housing 411 and thus also from the front side of the article of furniture 1. The height is thereby set in such a way that the weight of the separation element 11 is preferably completely assumed by the carriage 4 and the separation element 11 is simultaneously held at the provided height.

The inventive carriage 4 with the height adjustment described can also be advantageously used with other devices. It is not thereby compulsory for the holding bar 451 to be connected via a pivotable support lever 43 to the running wheels. The support lever can also be fixedly connected to the holding bar 451.

Furthermore the running wheels or running rollers, which can be provided in any number, can also be directly connected to the carriage body, while the holding bar 451 is connected to a separation element, for example a sliding door, and can hold this at an optionally adjustable height.

The holding bar can thereby be designed as desired. For example the holding bar can be formed as a thin hook, by means of which the fitting of a separation element, e.g. a wooden panel or a glass panel, is detected. Screw connections between the carriage and the fitting of the separation element, as described for example in [5], U.S. Pat. No. 6,052,867, can thus be drastically simplified. The fitting connected to the separation element can be reduced in its dimensions to the minimum and no longer requires the mounting of movable parts such as screws.

Nonetheless, it is of course also possible to form the holding bar as a screw, which is preferably rotatably connected to the holding wedge. In this case, with the aid of the rotation of the holding bar or the holding screw, a rough setting can be carried out and, with the aid of the adjusting screw, a fine setting can be carried out. In this case a detent element is preferably provided in the carriage body, for example a locking screw, by means of which the screw-form holding bar can be fixed. For example a vertically extending groove is provided in the holding bar, into which groove the locking screw can be rotated in order to hold it in a rotationally secure way, in which it can be displaced merely vertically.

FIG. 7*a* shows in part the bracket 21, seen from above, which is connected by means of hinges 3 to the separation element 11 and also to the scissor assembly bearing 6 and the carriage 4.

FIG. 7*b* shows the device of FIG. 7*a* seen from the front, e.g. during insertion into the door compartment 14. It is shown that the running wheels 44 of the carriage 4 are guided on a ridge of the running rail 27, whereby the bracket 21 is held exactly in position in terms of height and laterally.

FIG. 8 shows an inventive hinge 3 in the open position, with a mounting part 30 mounted on the bracket 21. Said mounting part 30 is connected to a hinge cup 38 on the one hand via a drive lever 31 driven by a drive spring 35 and on the other hand via an adjusting lever 32 and a mounting lever 33. It can be seen particularly clearly from FIG. 8 that all mounting screws 302 and adjusting screws 315 of the hinge 3 can be manipulated from the front, which is a great advantage to the installer.

FIG. 9 shows the mounting part 30 of FIG. 8 with a first bearing body 303 serving to hold a first bearing shaft 361 and two second bearing bodies 304 serving to hold a second bearing shaft 362. It can be seen that the first bearing shaft 361 is guided through two helical spring packages 353A, 353B of the drive spring 35, which are arranged on both sides of the bearing body 303. The end elements 351 of the drive spring 35 are anchored in a torque proof manner in the mounting part 30 while the middle part 352, which connects the two spring packages 353A, 353B to each other, lies free and can be turned about the first bearing shaft 361. Before inserting the first bearing shaft 361, the associated two-legged end element of the drive lever 31 is additionally placed upon the bearing body 33 in such a way that the middle part 352 of the drive spring 35 lies on the drive lever 31. By rotating the inserted drive lever 31 upwards the middle part 352 is thus also rotated upwards and the drive spring 35 is tensioned.

By means of the second bearing shaft 362, which is introduced into the second bearing bodies 304, the adjusting lever 32 is mounted. The second bearing bodies 304 can be anchored with a nose element 3041 in the mounting groove 2122 of the bracket 21, while the holding claws 305 provided on the mounting part 30 can surround the mounting strip 2121 on the mounting part 30. It is illustrated in FIG. 10 that the mounting part 30 and the mounting profile 21 can subsequently be mutually fixed in that mounting bolts 302 are guided through threaded bores 301 in the mounting part 30 and rotated towards the mounting profile 21. The holding claws 305 are subsequently drawn towards the mounting strip 2121 and the engagement of the second bearing bodies 304 in the mounting groove 2122 is thus secured.

FIG. 10*a* shows in a principle illustration furthermore the drive lever 31 driven by the drive spring 35, the adjusting lever 32 and the mounting lever 33, which together form a lever mechanism. It is shown that the adjusting lever 32 is connected by means of a third lever shaft 363 to the mounting lever 33. The mounting lever 33, which is connected to a mounting element 38 or a hinge cup, is connected by means of a fourth lever shaft 364 to the second end element of the drive lever 31. The drive lever 31 is pressed by the drive spring 35 constantly in the same direction towards the mounting lever 33 and the adjusting lever 32 and endeavours to reduce, through force effect, the distance a between the second lever shaft 362 and the fourth lever shaft 364. This reduction of the distance is managed in that the third lever shaft 363 is either guided towards the drive lever 31 or away from it. In this way the two end positions of the hinge 3 are reached under the force effect of the drive lever 31. The separation element 11 held is thus guided under force effect into the end position, in which the separation element 11 lies either perpendicular or parallel to the front of the article of furniture 1 or a building opening.

From the position, in which the second, third and fourth lever shaft 362, 363, 364 lie in a plane, the hinge 3 can thus tilt in one direction or the other, whereby the movement is supported in both directions over the whole tilt range by the drive lever 31 with virtually constant force. It is to be noted thereby that the drive spring 35, which can be formed to be extraordinarily powerful, transfers the force without friction losses to the drive lever 31, whereby an optimal effect is unleashed. At the same time wear is avoided, as the device parts of the hinge 3 work in a friction-free way.

FIG. 10*a* further shows that the minimum distance between the third lever shaft 363 and the drive lever 31 and thus an end position can be set by means of a stop screw 35. For example the stop screw 315 acts upon a stop element 321 provided on the adjusting lever 312, said stop element 321 being shown in FIG. 13.

FIG. 10*b* shows in a sectional representation the hinge 3 of FIG. 10*a* in a concrete embodiment with a hinge cup 38. In consideration of the size of the hinge cup 38 it can be recognised that the hinge 3 only has a small size and the lever mechanism 31, 32, 33 only takes up limited space. It is further shown that the hinge 3 is in the end stop, in which the door 11 is open and the stop screw 315 lies against the third lever shaft 363. The third lever shaft 363 is thereby preferably elastically formed so that upon reaching the end stop it can be bent back by the stop screw 315. The door 11 is thus elastically received in the end stop, whereby impact effects upon the hinge 3 are avoided. The hinge 3 and parts connected thereto are thus exposed to comparatively small loads, so that defect-free functioning of the hinge 3 is guaranteed over a long period. In order that the preferably hardened lever shaft 361 can be protected against over-extension, a stop element 321 is provided on the second lever 32. The compact structure of the hinge 3 with stable levers 31, 32, 33, adapted to each other, further allows heavy door elements 11 to be carried.

In advantageous embodiments at least one of the levers 31, 32, 33 of the lever mechanism is not formed straight, as shown in FIG. 10*a*. Instead, preferably slightly bent levers 31, 32, and/or 33 are used, which have minimum deformability and/or elasticity and can thus adapt to high forces in order to guarantee a defect-free interplay of the device parts. It is particularly advantageous for the drive lever 31 to be designed in a C, S or Z shape.

FIGS. 11*a*, 11*b* and 11*c* show the principle diagram of the hinge 3 of FIG. 10*b* with the lever mechanism in an open position (FIG. 11*a*), in a transitional position (FIG. 11*b*) and in a closed position (FIG. 11*c*). From the transitional position the hinge 3 can be tilted with the support of the drive lever 31 either into the position of FIG. 11*a*, in which the mounting lever 33 is orientated perpendicular to the article of furniture 1, or into the position of FIG. 11*c*, in which the mounting lever 33 is orientated horizontally to the article of furniture 1. It is to be noted that the drive spring 35 is tensioned most strongly in the transitional position and the drive lever 31 is rotated furthest back. From both end positions therefore force must be used in order to reach the transitional position.

FIGS. 12*a*, 12*b* and 12*c* show the hinge 3 in the concrete embodiment of FIG. 8 in an open position (FIG. 12*a*), in a transitional position (FIG. 12*b*) and in a closed position (FIG. 12*c*). It can be seen from FIG. 12*b* that the drive lever 31 is rotated back furthest in the transitional position.

FIG. 13 shows the inventive hinge 3 in an exploded view with lines, which show the insertion of the first, second, third and fourth bearing shaft 361, 362, 363, 364 in the individual device parts 30, 31, 32, 33 and 35. It is shown that all end elements of the levers 31, 32 and 33, save the second end element of the drive lever 31, each have two bearing elements separate from each other, which serve to receive the associated bearing shaft 362; 363; 364. The bearing elements at the end elements of the levers 31, 32 and 33 are thereby spaced apart from each other in such a way that they can be arranged adjacent to each other or to a bearing body 303; 304 with minimal intermediate spaces along the associated bearing shaft 361; 362; 363; 364. Furthermore the levers 31, 32 and 33 are formed in such a way that they can engage in each other or lie against each other with minimal space requirement. The mounting lever 33 is thereby formed as a U-shaped profile in such a way that it can be partially received by the hinge cup 38 and can for its part receive the drive lever 31 at least partially between its bearing elements.

For connection to the hinge cup 38 the mounting lever 33 comprises a connecting element 331 formed in the manner of a toothed rod, which connecting element 331 comprises an opening 3312 for passing through a connecting screw 381 and a lateral toothing 3311. The connecting screw 381 is guided through an opening in the bottom of the hinge cup 38 and rotated into a nut 382. The hinge cup 38 can be displaced along the connecting element 331 and can be fixed at a suitable point by tightening the connecting screw 381. It is shown in FIG. 14*c* that in order to displace the hinge cup 38 a Philips screwdriver can be lowered into a tool recess 385, so that the teeth of the screw driver engage in the toothing 3311 in the connecting element 331. After loosening of the connecting screw 381 the hinge cup 38 can thus be displaced by rotating the Philips screwdriver along the connecting element 331. This allows a particularly simple and precise adjustment of the position and the distance of the hinge cup 38 from the mounting strip 21.

FIGS. 14*a*, 14*b* and 14*c* show the assembly of the elements of the hinge 3. With reference to FIG. 9 the insertion of the first and the second bearing shaft 361, 362 and the connection of the drive lever 31, the drive spring 35 and the adjusting lever 32 with the mounting part 30 have been described.

FIG. 14*a* shows the mounting part 30 of FIG. 9 with inserted first bearing shaft 361, through which the drive spring 35 and the drive lever 31 are held, and with inserted second bearing shaft 362, through which the adjusting lever 32 is held.

FIG. 14*b* shows the mounting part 30 with the drive lever 31 and the adjusting lever 32, on the free lying end elements of which the third and fourth bearing shaft 363, 364 are inserted in order to mount the mounting lever 33.

FIG. 14*c* shows the completely assembled hinge 3 with the hinge cup 38 placed on the mounting lever 33.

FIG. 15*a* shows the mounting lever 33 with a mounting element 38, which is formed as a fitting for a glass door 11.

FIG. 15*b* shows an article of furniture 1 with a glass door 11, on which a door strip 110 is fixed, which encloses on both sides the mounting element 38 held in a receiving groove.

The displacement device 2 and the hinge 3 are in the position shown in FIG. 12*c*, in which the article of furniture 1, of which the outer side wall 15 is shown, is ended by the separation element 11. As mentioned, the invention can be advantageously used in the furniture industry. The inventive solution can, however, also be used in buildings advantageously for the closing off or division of areas.

The inventive displacement device 2 can thus be connected in various ways to any desired separation elements 11. The separation elements can be produced from any desired materials such as glass, metal, wood or plastic.

LITERATURE

[1] U.S. Pat. No. 5,149,180 A
[2] EP 0 909 864 A2
[3] EP 1 048 809 A1
[4] DE 3914103 A1
[5] U.S. Pat. No. 6,052,867

LIST OF REFERENCE NUMERALS

1 Article of furniture, cupboard
11 Separation element, e.g. wooden door or glass door
110 Door strip
12 Side wall
13 Intermediate wall
14 Door compartment
15 Side wall
2 Displacement device
21 Mounting bracket, strut
211 First mounting profile of the bracket 21
2111 Mounting channel in the first mounting profile 211
212 Second mounting profile of the bracket 21
2121 Mounting strip on the second mounting profile 212
2122 Mounting groove on the second mounting profile 212
22 Scissor assembly
221 First beam
222 Second beam
223 Scissor joint
23 Anchoring means
24 Guide device
26 Guide profile
27 Upper guide rail
28 Lower guide rail
281 Guide channel in the lower guide rail 28
3 Hinge
30 Mounting part of the hinge 3
301 Threaded bores in the mounting part 30
302 Mounting bolt for the threaded bores 301
303 First bearing body for the first lever shaft 361
304 Second bearing body for the second lever shaft 362 and for connection to the bracket 21
3041 Nose on the bearing body 304
305 Holding claws for connection to the bracket 21
31 Drive lever
315 Stop screw for setting the lever distance
32 Adjusting lever
321 Stop element on the adjusting lever 32
33 Mounting lever
331 Connecting element, toothed rod
3311 Toothing
3312 Opening for receiving the connecting screw 381
35 Drive spring, double helical spring

361 First lever shaft
362 Second lever shaft
363 Third lever shaft, respectively spring elastic and hardened
364 Fourth lever shaft
38 Mounting element, possibly hinge cup on the mounting lever 33
381 Connecting screw
382 Connecting nut
385 Tool recess
4 Carriage
41 Carriage body
411 Housing of the carriage body 41
4111 Outlet opening in the housing 411
4112 Bearing opening
4113 Threaded bores for the end screws 423
4114 Guide beam in the carriage housing 411
412 Mounting part on the carriage housing 41
4121 Threaded bores for the mounting screws 4122
4122 Mounting screws
42 Housing lid
421 Bearing block on the housing lid 43
422 Receiving openings for the end screws 423
423 End screws
43 Support lever
431 Central axle for the support lever 43
432 Receiving openings for the wheel axles 441
44 Running wheels
441 Wheel axles
45 Adjusting element
451 Holding bar of the adjusting element
452 Holding wedge of the adjusting element
453 Bearing opening for receiving the central axle 431
46 Adjusting screw
461 Screw head of the adjusting screw 46
462 Threaded shank of the adjusting screw 46
47 Adjusting wedge
471 Threaded channel in the adjusting wedge
6 Scissor assembly bearing
61 Profile body of the scissor assembly bearing 6
611 First profile part of the profile body 61
6111 Holding claw on the first profile part 611
612 Second profile part of the profile body 61
6121 Holding strip on the second profile part 612
6122 Threaded bores in the second profile part 612
613 Third profile part of the profile body 61
6131 Mounting opening in the third profile part
6132 Threaded channel for receiving the adjusting bolt 63
6133 Foot element of the third profile part
61331 Guide channel in the foot element 6133
62 Adjusting lever
621 Mounting lug on the adjusting lever 62
622 Receiving opening on the adjusting lever 62
623 Mounting opening on the adjusting lever 62
624 Guide nose on the adjusting lever 62
63 Adjusting bolt
631 Head of the adjusting bolt 63
632 Threaded shank of the adjusting bolt 63
633 Tool opening in the threaded shank 632
64 Mounting shaft
66 Stop bolt
67 Fixing screws
68 Bearing screw for holding the second beam
8 Guide device

The invention claimed is:

1. Displacement device with a separation element for an article of furniture or for a building area, wherein the separation element is pivotally connected to a bracket that is held slideably by a first beam of a scissor assembly and firmly by a second beam of the scissor assembly with a scissor assembly bearing, wherein the scissor assembly bearing comprises a profile body adapted to the bracket and connectable thereto, wherein the profile body comprises a profile part that is pivotally connected by a mounting shaft to a first end element of an adjusting lever, wherein the adjusting lever comprises a second end element that is provided with a mounting lug that is traversed by a bearing screw that is connected with one of said beams and that the second end element of the adjusting lever is held by a first end of an adjusting bolt, and wherein the adjusting bolt comprises a threaded shank that is rotatably mounted in a threaded channel of the profile body.

2. Displacement device according to claim 1, wherein the threaded channel runs through the profile body from a rear side facing the scissor assembly to a front side, so that the adjusting bolt can be manipulated from the front side of the profile body.

3. Displacement device according to claim 1, wherein the adjusting bolt comprises on a front side a tool opening, into which a tool can be introduced, in order to rotate the adjusting bolt.

4. Displacement device according to claim 1, wherein the adjusting bolt comprises at an end facing the adjusting lever a bolt head, which is anchored in a receiving opening provided in the adjusting lever.

5. Displacement device according to claim 1, wherein the mounting lug comprises an elongated opening, along which a shank of the bearing screw can be displaced.

6. Displacement device according to claim 1, wherein the second end element of the adjusting lever is provided with a guide nose, wherein the guide nose is guided and laterally held in a guide channel provided in a foot element of the profile part.

7. Displacement device according to claim 1, wherein the profile body comprises an L-shaped profile or a U-shaped profile and also comprises threaded bores, into which fixing screws can be rotated against the bracket in order to mutually block the bracket and the profile body.

8. Displacement device according to claim 1, wherein the bracket is held at its upper end by a carriage, which comprises a carriage body with a housing, in which housing an adjusting element is mounted so that the adjusting element can be displaced in height, on an upper side of which adjusting element a support lever is pivotally held, on which two running wheels guided by a running rail are fixed by means of wheel axles.

9. Displacement device according to claim 8, wherein the adjusting element comprises a holding bar, on an upper side of which the support lever is held by means of a central axle and on a lower side of which a holding wedge is provided, of which an upper wedge face, which is inclined in relation to a running direction of the carriage, cooperates with a lower wedge face of an adjusting wedge, which is displaceable in relation to the holding wedge by means of an adjusting screw held by the carriage body.

10. Displacement device according to claim 9, wherein the adjusting screw comprises a threaded shank and at each end a respective screw head, which screw heads are held in bearing openings, which are arranged in sides of the housing, lying opposite each other, and wherein the threaded shank is rotatably held in a threaded channel of the adjusting wedge.

11. Displacement device according to claim 1, wherein the separation element is held by a mounting element of a hinge, wherein the mounting element is connected via a lever mechanism to a mounting part fixed to the bracket, wherein the mounting part is connected in an articulated way to a first end element of a drive lever driven by a drive spring and to the first a first end element of a second adjusting lever, wherein the second adjusting lever has a second end element that is connected in an articulated way to a first end element of a mounting lever connected to the mounting element, wherein the mounting lever has a second end element that is connected to a second end element of the drive lever, which presses the mounting lever towards the second adjusting lever so that a third lever shaft, which is connecting the second adjusting lever and the mounting lever, is pushed towards the drive lever when the separation element is open and is pushed away from the drive lever when the separation element is closed.

12. Displacement device according to claim 11, wherein the mounting part comprises a first bearing body, in which a first lever shaft serving to hold the drive lever is mounted, on which first lever shaft on one or both sides of the first bearing body a respective spring package of the drive spring formed as a helical spring is arranged, which presses on the one hand against the mounting part and on the other hand with an end element or a middle element against the drive lever and in that the mounting part comprises a second bearing body, in which a second lever shaft serving to hold the second adjusting lever is held and in that the drive lever and the mounting lever are connected to each other by a fourth lever shaft.

13. Displacement device according to claim 11, wherein a stop screw is rotatably mounted in the drive lever, wherein the stop screw has a minimal distance between on the one hand the spring elastic third lever shaft or a stop element on the second adjusting lever and on the other hand the drive lever and hence an orientation of the separation element in an open position can be set and in that the mounting element is displaceable in relation to the mounting lever and can be fixed by means of a connecting screw and a multi-edged nut.

14. Displacement device according to claim 11, wherein the mounting element is a hinge cup, wherein the mounting lever comprises at least in part a U-shaped profile, which is fitted into the hinge cup, and which serves to receive the drive lever in a position, in which the third lever shaft is pressed towards the drive lever, wherein the second end element of the second adjusting lever and the first end element of the mounting lever each comprise two adjacent bearing bodies serving to receive the third lever shaft, which bearing bodies, of the second end element of the second adjusting lever and of the first end element of the mounting lever respectively, are spaced apart from each other in such a way that the drive lever can be guided between them towards the third lever shaft.

15. Article of furniture with a displacement device according to claim 1, wherein the separation element, which is connected to the displacement device and is serving to close the article of furniture, is retractable therein into an intermediate space.

* * * * *